US009896933B1

(12) United States Patent
Knezek et al.

(10) Patent No.: US 9,896,933 B1
(45) Date of Patent: Feb. 20, 2018

(54) CONTINUOUSLY VARIABLE DISPLACEMENT ENGINE

(71) Applicant: AMERIBAND, LLC, Arlington, TX (US)

(72) Inventors: Robert A. Knezek, Arlington, TX (US); Michael J. Pastusek, Arlington, TX (US)

(73) Assignee: AMERIBAND, LLC, Arlington, TX (US)

( * ) Notice: Subject to any disclaimer, the term of this patent is extended or adjusted under 35 U.S.C. 154(b) by 0 days.

(21) Appl. No.: 15/403,143

(22) Filed: Jan. 10, 2017

Related U.S. Application Data

(63) Continuation-in-part of application No. 14/829,442, filed on Aug. 18, 2015, now Pat. No. 9,540,932, which is a continuation-in-part of application No. 13/368,198, filed on Feb. 7, 2012, now Pat. No. 9,109,446.

(60) Provisional application No. 61/462,700, filed on Feb. 7, 2011.

(51) Int. Cl.

| | |
|---|---|
| ***F01B 3/02*** | (2006.01) |
| ***F01B 3/10*** | (2006.01) |
| ***F01B 3/00*** | (2006.01) |
| ***F04B 1/29*** | (2006.01) |

(52) U.S. Cl.
CPC ..... *F01B 3/0023* (2013.01); *F01B 3/02* (2013.01); *F01B 3/102* (2013.01)

(58) Field of Classification Search
CPC ..... F01B 3/102; F01B 3/0023; F04B 1/295
USPC ..... 92/12.1, 12.2, 13, 71
See application file for complete search history.

(56) References Cited

U.S. PATENT DOCUMENTS

| | | | | | |
|---|---|---|---|---|---|
| 1,788,609 | A * | 1/1931 | Andrews | F16H 23/08 | 123/56.4 |
| 1,910,054 | A * | 5/1933 | Rayburn | B60K 17/10 | 60/451 |
| 2,532,254 | A * | 11/1950 | Bouchard | F02B 75/26 | 123/56.4 |
| 3,631,763 | A * | 1/1972 | Court | F01B 3/0044 | 91/506 |

(Continued)

FOREIGN PATENT DOCUMENTS

CN 101749122 A 6/2010

*Primary Examiner* — Thomas E Lazo
*Assistant Examiner* — Matthew Wiblin
(74) *Attorney, Agent, or Firm* — Munck Wilson Mandala LLP

(57) ABSTRACT

A variable-displacement engine comprises an engine block, power shaft and rotating cylinder block. Pistons and connecting rods mounted in the cylinder block connect to a wobble plate having a rotating ring portion and non-rotating ring portion connected to allow relative rotation therebetween while constraining the portions to remain parallel. The wobble plate defines an inclination plane, pivot axis and wobble plate angle θ. A piston control mechanism includes axial lift, control lever supported by the lift and by an anchor bearing, and links connecting the control lever to the wobble plate. Axial movement of the lift changes the axial position of the control lever pivot and changes the control lever angle, in turn changing, via the connecting links, the wobble plate angle θ and the axial position of the wobble plate pivot axis. This changes the piston displacement of the engine while maintaining substantially constant compression ratio.

4 Claims, 25 Drawing Sheets

(56) References Cited

U.S. PATENT DOCUMENTS 4,077,269 A * 3/1978 Hodgkinson ..... F01B 3/0088 417/269
4,094,202 A 6/1978 Kemper
4,100,815 A 7/1978 Kemper
4,117,736 A 10/1978 Kemper et al.
4,433,596 A * 2/1984 Scalzo ..... F01B 3/02 123/56.3
4,497,284 A * 2/1985 Schramm ..... F01B 13/06 123/41.47
5,513,553 A * 5/1996 Gleasman ..... F01B 3/02 74/60
5,553,582 A * 9/1996 Speas ..... F01B 3/02 123/56.4
5,782,219 A 7/1998 Frey et al.
5,955,291 A 9/1999 Alitalo et al.
6,397,794 B1 6/2002 Sanderson et al.
6,446,587 B1 9/2002 Sanderson et al.
6,460,450 B1 10/2002 Sanderson et al.
6,694,931 B2 2/2004 Palmer
6,829,978 B2 12/2004 Sanderson et al.
6,854,377 B2 2/2005 Sanderson et al.
6,883,416 B2 * 4/2005 Koelzer ..... F04B 27/1072 91/505
6,913,447 B2 7/2005 Fox et al.
6,915,765 B1 7/2005 Sanderson et al.
6,925,973 B1 8/2005 Sanderson et al.
6,968,751 B2 11/2005 Shulenberger et al.
7,007,589 B1 3/2006 Sanderson
7,011,469 B2 3/2006 Sanderson et al.
7,040,263 B2 5/2006 Sanderson et al.
7,140,343 B2 11/2006 Sanderson
7,153,105 B2 * 12/2006 Koelzer ..... F04B 27/1081 417/269
7,162,948 B2 1/2007 Sanderson et al.
7,185,578 B2 3/2007 Sanderson
7,270,092 B2 9/2007 Hefley
7,325,476 B2 * 2/2008 Sanderson ..... F01B 3/102 91/505
7,331,271 B2 2/2008 Sanderson et al.
7,334,548 B2 2/2008 Sanderson et al.
7,409,932 B2 8/2008 Gaiser
7,438,029 B2 10/2008 Fox et al.
2002/0157624 A1 10/2002 Janak
2007/0245992 A1 10/2007 Hefley
2009/0107327 A1 4/2009 Ota et al.
2010/0278463 A1 * 11/2010 Becker ..... F04B 1/2085 384/2

* cited by examiner

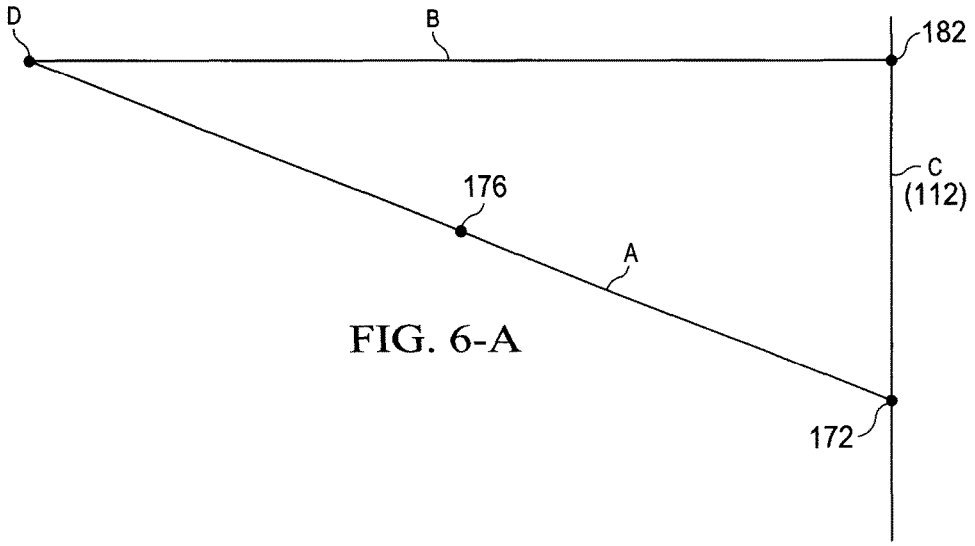
FIG. 6-A
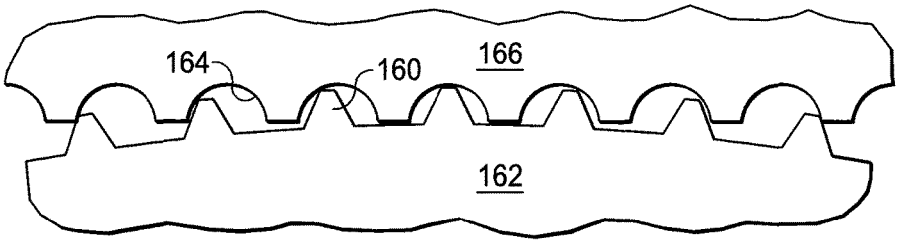
FIG. 6-B

CONTINUOUSLY VARIABLE DISPLACEMENT ENGINE

CROSS-REFERENCE TO RELATED APPLICATIONS

This application is a Continuation-In-Part of U.S. patent application Ser. No. 14/829,442, filed on Aug. 18, 2015, entitled CONTINUOUSLY VARIABLE DISPLACEMENT ENGINE, which issues on Jan. 10, 2017, as U.S. Pat. No. 9,540,932. U.S. application Ser. No. 14/829,442 is a Continuation-In-Part of U.S. patent application Ser. No. 13/368,198, filed on Feb. 7, 2012, entitled CONTINUOUSLY VARIABLE DISPLACEMENT ENGINE, which issued on Aug. 18, 2015, as U.S. Pat. No. 9,109,446. U.S. application Ser. No. 13/368,198 claims benefit of U.S. Provisional Application No. 61/462,700, filed on Feb. 7, 2011, entitled CONTINUOUSLY VARIABLE DISPLACEMENT ENGINE. U.S. patent application Ser. Nos. 14/829,442, 13/368,198 and 61/462,700, and U.S. Pat. Nos. 9,109,446 and 9,540,932 are incorporated by reference herein in their entirety.

TECHNICAL FIELD

The present invention relates to an internal combustion piston engine having a wobble plate or swash plate. In particular, it relates to a wobble plate engine in which the piston displacement can be continuously varied over a range of displacements while maintaining a constant compression ratio, or while varying the compression ratio in predetermined relation to the selected displacements.

BACKGROUND

Current internal combustion engines typically use one or more pistons in single, opposed, in-line or V arrangements. They use a crankshaft where the piston is connected to a crankshaft through a connecting rod. The crankshaft has one or more bearings offset from the center of the shaft that drive the pistons back and forth as the shaft turns to ingest and exhaust gases contained by the piston in a cylindrical space in the engine block. They operate with a constant displacement and constant compression ratio. Thus they are essentially constant displacement engines. Some attempts (such as in some Cadillac and Honda automobiles) have been made to vary displacement by inactivating use of certain cylinders in a multi-piston engine. The engine displacement is changed in discontinuous steps limiting fuel efficiency over a continuously variable displacement engine. Also, the frictional losses are not reduced in this design at reduced power and engine control becomes more complex.

Aircraft engines have also been designed with multiple pistons arranged in a radial manner around a single offset bearing on the crank shaft. This arrangement is used when high torque is required and the engine speed (rotations per minute) is not very high.

High speed rotary compressors and turbines have also been used in engine designs, primarily in aircraft applications, where air is drawn through the engine, mixed with fuel and combustion is internal to the engine. These applications are generally not suitable for land vehicle or industrial uses because of cost and low fuel efficiency.

Many factors affect the useful power that is produced by an internal combustion engine. The five main variables for a piston engine are the engine displacement, speed (rotations per minute), compression ratio, inlet air pressure and fuel-to-air ratio. Thermodynamic principles indicate that for an internal combustion engine of fixed displacement, maximum fuel efficiency (ratio of useful power to fuel consumed) of traditional engines occurs near the conditions of maximum inlet air pressure, which is also near the maximum power setting for a given engine speed. In internal combustion engine applications, the common method of controlling power produced is to lower intake pressure until the desired power level is produced. Thus the engine is normally operating at reduced efficiency.

U.S. Pat. No. 5,553,582, issued to Speas, shows an engine based on the wobble plate concept wherein the engine design is capable of varying engine displacement, cylinder compression ratio, valve timing and valve travel. The Speas design may be considered very complex, and may not be practical for an operational engine. The complex mechanisms in the Speas patent required to achieve all the variables are not needed in a fuel efficient engine and may prevent the design from being implemented.

SUMMARY

One embodiment comprises a 4-stroke piston engine with one or more cylinders arranged around a central straight power shaft. The axes of the cylinders are parallel to the axis of the power shaft. A piston control mechanism is linked to the power shaft at a variable angle with respect to the power shaft axis. The piston control mechanism transforms the forces from the piston(s) into torque to turn the power shaft. As the displacement is continuously varied, the top of the piston stroke is automatically varied to maintain a constant compression ratio throughout the full range of displacement. Maintaining a constant compression ratio throughout the range of piston displacement permits the engine to maintain full intake air pressure and maximum fuel efficiency over a wide range of power demand.

In a preferred embodiment, the range of engine displacement can be continuously and smoothly varied over at least a range of 3:1. In another preferred embodiment, lesser power demand is met by restricting intake air flow and fuel (limiting intake air pressure) at minimum displacement. Variations in valve timing are readily achieved by a simple actuation mechanism. This combination of engine features improves fuel efficiency over conventional designs in applications wherein the engine will routinely operate at various power demands.

In still other embodiments, an engine is provided having numerous advantages over conventional designs in addition to those previously described. In some embodiments, the engine requires a small spatial envelope. In other embodiments, the engine weight is reduced by the structural efficiency of the straight power shaft, structural efficiency of the engine block and reduction of weight in the pistons and connecting rods due to lower side forces. In other embodiments, the inertial forces are also lower because of the reduced weight and the feature that the primary inertial mode is balanced in multi-piston engine configurations.

In still other embodiments, an engine is provided that is readily scalable and is readily adapted to other piston control mechanism configurations. In various embodiments, the engine can accommodate up to five cylinders with little change in engine spatial envelope over a single cylinder design. In other embodiments, the engine competes favorably with much more complicated and costly hybrid power trains (i.e., combined internal combustion and electrical) in automotive engine systems. In other embodiments, the engine provides improved fuel efficiency may be even more important in large truck applications, especially for long cross-country routes where fuel costs are a high part of the transportation cost. In other embodiments, two or more sets of pistons can also be grouped together in various arrangements.

In still other embodiments, hydraulically powered valve lifters (rather than conventional cams) and/or a hydraulic piston replacement for the mechanical piston control mechanism actuator may offer further improvements. In other embodiments, hydraulic valve actuation permits an electronic engine control unit to vary valve timing and/or valve open duration and/or rate of valve opening and closing and/or valve travel.

In another embodiment, an engine comprises an engine block, an elongated power shaft rotatably supported by the engine block, the power shaft having a longitudinal axis, and at least one cylinder supported by the engine block. Each cylinder has a bore defining a bore axis aligned substantially parallel to the longitudinal axis of the power shaft. The engine of this embodiment further comprises one or more pistons corresponding in number to the number of the cylinders, each respective piston being slidably disposed within the bore of a respective cylinder. The engine of this embodiment further comprises a wobble plate assembly having a generally annular configuration defining a central opening through which central opening the power shaft passes, the wobble plate assembly including a central support member, a first ring portion, a second ring portion and a ring bearing assembly. The central support member is longitudinally slidably mounted on the power shaft and defines a pivot axis for the wobble plate assembly. The pivot axis intersects the longitudinal axis of the power shaft in a perpendicular orientation and rotates with the power shaft. The first ring portion is pivotally mounted on the central support member such that the first ring portion pivots about the pivot axis and rotates with the central support member. The second ring portion is concentrically disposed adjacent the first ring portion and has mounted thereon one or more connecting rod bearings corresponding in number to the number of the cylinders. The ring bearing assembly is connected between the first ring portion and the second ring portion so as to allow the first ring portion to rotate about the common center relative to the second ring portion while constraining the second ring portion to remain parallel to the first ring portion. The wobble plate assembly, when viewed in a direction parallel to the pivot axis, defines a wobble plate inclination plane and a wobble plate inclination angle $\theta$, the wobble plate inclination plane being seen as a line passing through the center of the pivot axis and the center of the connecting rod bearing(s), when viewed in a direction parallel to the pivot axis, and the wobble plate inclination angle $\theta$ being the angle of intersection between the wobble plate inclination plane and a line perpendicular to the longitudinal axis of the power shaft, when viewed parallel to the pivot axis. The engine of this embodiment further comprises a displacement actuator operatively connected between the engine block and the central support member, the displacement actuator selectively moving the central support member along the power shaft so as to longitudinally position the pivot axis of the wobble plate assembly at a user-selectable distance d from a theoretical zero displacement point on the longitudinal axis. The engine of this embodiment further comprises a piston control linkage operatively connected to the wobble plate assembly, the piston control linkage setting the wobble plate inclination angle $\theta$ as the distance d changes so as to maintain a linear relationship between d and $\sin(\theta)$ such that $d=W \sin(\theta)$, where W is a constant. The engine of this embodiment further comprises an anti-rotation assembly having a first portion operatively connected to the second ring portion of the wobble plate assembly and a second portion operatively connected to the engine block, the anti-rotation assembly preventing rotation of the second ring portion of the wobble plate assembly relative to the engine block. The engine of this embodiment further comprises a torque assembly having a first portion operatively connected to the first ring portion of the wobble plate assembly and a second portion operatively connected to the power shaft, the torque assembly transmitting torque between the first ring portion and the power shaft to cause rotation of the power shaft relative to the engine block when the first ring portion rotates relative to the engine block. The engine of this embodiment further comprises one or more connecting rods corresponding in number to the number of cylinders, each respective connecting rod having an upper end connected to a respective piston and a lower end connected to a respective connecting rod bearing on the second ring member of the wobble plate assembly such that reciprocation of the piston(s) within the cylinder bore(s) results in rotation of the power shaft. Operation of the displacement actuator to selectively change the pivot axis-to-zero point distance d within a range between a maximum distance dmax and a minimum distance dmin, where the ratio of dmax/dmin=N, correspondingly changes the piston displacement DP of the engine within a range between a maximum displacement DPmax and a minimum displacement DPmin having a ratio DPmax/DPmin=N, while the piston control linkage maintains the compression ratio of the engine at a substantially constant value as the displacement changes within the range between DPmax and DPmin.

In another embodiment, an engine comprises an engine block supporting a plurality of cylinders spaced apart around a rotatably mounted central power shaft having a longitudinal axis, each respective cylinder having a respective bore defining a bore axis aligned substantially parallel to the longitudinal axis and having a respective piston slidably disposed therein, each respective piston having connected thereto an upper end of a respective connecting rod also having a lower end. The engine of this embodiment further comprises a wobble plate assembly mounted on the power shaft, the wobble plate assembly including a first ring portion, a second ring portion and a ring bearing assembly. The first ring portion is operatively mounted on the power shaft such that the first ring portion rotates with the power shaft and pivots about a pivot axis intersecting the longitudinal axis of the power shaft in a perpendicular orientation and rotating with the power shaft. The second ring portion is concentrically disposed adjacent the first ring portion and has mounted thereon a plurality of connecting rod bearings corresponding in number to the number of the cylinders, each respective connecting rod bearing being connected to the lower end of a respective connecting rod, the second ring portion being operatively connected to the engine block so as to prevent the second ring portion from rotating relative to the engine block. The ring bearing assembly is connected between the first ring portion and the second ring portion so as to allow the first ring portion to rotate about the common center relative to the second ring portion while constraining the second ring portion to remain parallel to the first ring portion. Reciprocation of the pistons within the cylinder bores results in rotation of the power shaft. The wobble plate assembly, when viewed in a direction parallel to the pivot axis, defines a wobble plate inclination plane and a wobble plate inclination angle $\theta$, the wobble plate inclination plane being seen as a line passing through the center of the pivot axis and the center of the connecting rod bearings, when viewed in a direction parallel to the pivot axis, and the wobble plate inclination angle θ being the angle of intersection between the wobble plate inclination plane and a line perpendicular to the longitudinal axis of the power shaft, when viewed parallel to the pivot axis. The engine of this embodiment further comprises a displacement actuator operatively connected between the engine block and the wobble plate assembly, the displacement actuator selectively moving the wobble plate assembly along the power shaft so as to longitudinally position the pivot axis of at a user-selectable distance d from a theoretical zero displacement point on the longitudinal axis. The engine of this embodiment further comprises a piston control linkage operatively connected to the wobble plate assembly, the piston control linkage setting the wobble plate inclination angle θ as the distance d changes such that $d=W \sin(\theta)$, where W is a constant. Operation of the displacement actuator to selectively change the pivot axis-to-zero point distance d within a range between a maximum distance dmax and a minimum distance dmin, where the ratio of dmax/dmin=N, correspondingly changes the piston displacement DP of the engine within a range between a maximum displacement DPmax and a minimum displacement DPmin having a ratio DPmax/DPmin=N, while the piston control linkage maintains the compression ratio of the engine at a substantially constant value as the displacement changes within the range between DPmax and DPmin.

In another embodiment, an engine comprises an engine block supporting a plurality of cylinders spaced apart around a rotatably mounted central power shaft having a longitudinal axis, each respective cylinder having a respective bore defining a bore axis aligned substantially parallel to the longitudinal axis and having a respective piston slidably disposed therein, each respective piston having connected thereto an upper end of a respective connecting rod also having a lower end. The engine of this embodiment further comprises a wobble plate assembly mounted on the power shaft, the wobble plate assembly including a first ring portion, a second ring portion and a ring bearing assembly. The first ring portion is operatively mounted on the power shaft such that the first ring portion rotates with the power shaft and pivots about a pivot axis intersecting the longitudinal axis of the power shaft in a perpendicular orientation and rotating with the power shaft. The second ring portion is concentrically disposed adjacent the first ring portion and has mounted thereon a plurality of connecting rod bearings corresponding in number to the number of the cylinders, each respective connecting rod bearing being connected to the lower end of a respective connecting rod, the second ring portion being operatively connected to the engine block so as to prevent the second ring portion from rotating relative to the engine block. The ring bearing assembly is connected between the first ring portion and the second ring portion so as to allow the first ring portion to rotate about the common center relative to the second ring portion while constraining the second ring portion to remain parallel to the first ring portion. Reciprocation of the pistons within the cylinder bores results in rotation of the power shaft. The wobble plate assembly, when viewed in a direction parallel to the pivot axis, defines a wobble plate inclination plane and a wobble plate inclination angle, the wobble plate inclination plane being seen as a line passing through the center of the pivot axis and the center of the connecting rod bearings, when viewed in a direction parallel to the pivot axis, the wobble plate inclination angle being the angle of intersection between the wobble plate inclination plane and a line perpendicular to the longitudinal axis of the power shaft, when viewed parallel to the pivot axis. The engine of this embodiment further comprises a displacement actuator operatively connected between the engine block and pivot axis, the displacement actuator selectively moving the wobble plate assembly along the power shaft so as to longitudinally position the pivot axis within a range of positions along the longitudinal axis. The engine of this embodiment further comprises a piston control linkage operatively connected to the wobble plate assembly, the piston control linkage setting the wobble plate inclination angle as the longitudinal position of the pivot axis changes to maintain a constant compression ratio. Operation of the displacement actuator to selectively change the longitudinal position of the pivot axis within a range between a first position and a second position correspondingly changes the piston displacement of the engine within a range between a maximum displacement and a minimum displacement.

In another aspect, a variable-displacement engine comprises an engine block, power shaft and rotating cylinder block. Pistons and connecting rods mounted in the cylinder block connect to a wobble plate having a rotating ring portion and non-rotating ring portion connected to allow relative rotation therebetween while constraining the portions to remain parallel. The wobble plate defines an inclination plane, pivot axis and wobble plate angle θ. A piston control mechanism includes axial lift, control lever supported by the lift and by an axially fixed anchor bearing, and links connecting the control lever to the wobble plate. Axial movement of the lift changes the axial position of the control lever pivot and changes the control lever angle, in turn changing, via the connecting links, the wobble plate angle θ and the axial position of the wobble plate pivot axis. This changes the piston displacement of the engine while maintaining substantially constant compression ratio.

In yet another aspect, a variable-displacement engine comprises an engine block and an elongated power shaft rotatably supported by the engine block, the power shaft having a longitudinal axis defining an axial direction and being fixed axially relative to the engine block. A rotating cylinder block defines at least one cylinder, each cylinder having a bore defining a bore axis aligned substantially parallel to the power shaft axis, with the cylinder block being fixedly mounted to the power shaft such that when the power shaft rotates, the cylinder block rotates around the power shaft axis and each bore axis revolves around the power shaft axis. One or more pistons are provided corresponding in number to the number of the cylinders, each respective piston being slidably disposed within the bore of a respective cylinder. One or more connecting rods are provided corresponding in number to the number of cylinders, each respective connecting rod having an upper end connected to a respective piston and a lower end connected to a respective connecting rod bearing. A wobble plate assembly is provided having a generally annular configuration defining a central opening through which the power shaft passes, the wobble plate assembly including a rotating first ring portion, the first ring portion including one or more bearing mounting arms formed thereon, corresponding in number to the number of the connecting rods, each bearing mounting arm having a respective connecting rod bearing mounted thereon, and a non-rotating second ring portion, the second ring portion being rotatably slidably connected to the first ring portion so as to allow the first ring portion to rotate relative to the second ring portion about a common ring center line while constraining the second ring portion to remain parallel to the first ring portion. A rotation-locking assembly is provided connected between the first ring portion and the power shaft to rotationally lock the first ring portion to the power shaft while allowing the first ring portion to vary an angle of inclination with respect to the power shaft axis. The wobble plate assembly defines a wobble plate inclination plane being a plane passing through the centers of the connecting rod bearings, a wobble plate pivot axis being a line lying in the wobble plate inclination plane and intersecting the longitudinal axis of the power shaft in a perpendicular orientation and rotating with the power shaft, and a wobble plate angle θ being an angle of intersection between the wobble plate inclination plane and a plane normal to the power shaft axis when viewed in a direction parallel to the pivot axis. A piston control mechanism is provided, including a lift mechanism slidably mounted on the engine block for axial movement along the power shaft axis, a control lever supported at a first location by pivot bearings mounted to the lift mechanism along a normal line passing through the power shaft axis parallel to the wobble plate pivot axis and supported at a second location by an anchor bearing disposed at an axially fixed position, thereby defining a control lever centerline passing through the centers of the pivot bearing and the anchor bearing and an control lever angle being an angle between the control lever centerline and a plane normal to the power shaft axis when viewed in a direction parallel to the pivot axis, and two or more spaced-apart connecting links, each connecting link having a first end connected to the second ring portion of the wobble plate and a second end connected to the control lever. Operation of the lift mechanism to selectively change the axial position of the control lever pivot bearings selectively changes the control lever angle, which in turn selectively changes, via the connecting links, the wobble plate angle θ and the axial distance d between the wobble plate pivot axis and a theoretical zero angle point, which in turn selectively changes the piston displacement of the engine while maintaining the compression ratio of the engine at a substantially constant value.

In one embodiment, the rotation-locking assembly is a constant velocity joint including an inner joint portion connected to the power shaft and having a plurality of radially outward facing races formed thereon, an outer joint portion connected to first ring portion of the wobble plate and having a plurality of radially inward facing races formed thereon, each race of the outer joint portion facing a corresponding race on the inner joint portion, and a plurality of race balls, each race ball captured between the corresponding inward facing and outward facing races of the respective joint portions.

In another embodiment, the anchor bearing supporting the control lever at the second location is mounted in a slider block and the slider block is slidingly mounted to the engine block to move in a radial direction along a normal line extending from the power shaft axis but is constrained against movement in the axial direction and constrained against movement in a circumferential direction around the power shaft axis.

In still another embodiment, the anchor bearing supporting the control lever at the second location is mounted to the engine block at a fixed axial location, at a fixed radial distance from the power shaft axis and at a fixed circumferential location and the outer end of the control lever includes a slot slidingly engaged over the anchor bearing to allow sliding movement of the outer end of the control lever along the anchor support bearing.

In a further embodiment, the wobble plate assembly, connecting links and control lever are configured to maintain the wobble plate inclination plane parallel to the centerline of the control lever such that the wobble plate angle θ is equal to the angle of intersection between the control lever centerline and a plane normal to the power shaft axis.

In yet another embodiment, the wobble plate assembly, connecting links and control lever are configured such that the wobble plate inclination plane is not parallel to the centerline of the control lever, but changing the angle of intersection between the control lever centerline and a plane normal to the power shaft axis changes the wobble plate angle θ.

In still another embodiment, the piston control mechanism is operatively connected to the wobble plate assembly to set the wobble plate inclination angle θ as the axial distance d between the position of the wobble plate pivot axis and a theoretical zero angle point changes so as to maintain a linear relationship between d and sin(θ) such that $d=K\cdot\sin(\theta)$, where K is a constant.

In another aspect, a variable-displacement engine comprises an engine block and an elongated power shaft rotatably supported by the engine block, the power shaft having a longitudinal axis defining an axial direction and being fixed axially relative to the engine block. A rotating cylinder block is provided defining at least one cylinder, each cylinder having a bore defining a bore axis aligned substantially parallel to the power shaft axis, the cylinder block being fixedly mounted to the power shaft such that when the power shaft rotates, the cylinder block rotates around the power shaft axis and each bore axis revolves around the power shaft axis. One or more pistons are provided corresponding in number to the number of the cylinders, each respective piston being slidably disposed within the bore of a respective cylinder. One or more connecting rods are provided corresponding in number to the number of cylinders, each respective connecting rod having an upper end connected to a respective piston and a lower end connected to a respective connecting rod bearing. A wobble plate assembly is provided having a generally annular configuration defining a central opening through which the power shaft passes. The wobble plate assembly includes a rotating first ring portion, the first ring portion including one or more bearing mounting arms formed thereon, corresponding in number to the number of the connecting rods, each bearing mounting arm having a respective connecting rod bearing mounted thereon. A non-rotating second ring portion is rotatably slidably connected to the first ring portion so as to allow the first ring portion to rotate relative to the second ring portion about a common ring center line while constraining the second ring portion to remain parallel to the first ring portion. A rotation-locking assembly is connected between the first ring portion and the power shaft to rotationally lock the first ring portion to the power shaft while allowing the first ring portion to vary an angle of inclination with respect to the power shaft axis. The wobble plate assembly defines a wobble plate inclination plane being a plane passing through the centers of the connecting rod bearings, a wobble plate pivot axis being a line lying in the wobble plate inclination plane and intersecting the longitudinal axis of the power shaft in a perpendicular orientation and rotating with the power shaft, and a wobble plate angle θ being an angle of intersection between the wobble plate inclination plane and a plane normal to the power shaft axis when viewed in a direction parallel to the pivot axis. A piston control mechanism is provided including a lift mechanism mounted on the engine block and operatively connected to a first location on the non-rotating second ring portion to selectively move the first location on the second ring portion in an axial direction, and an axial anchor arm extending from a second location on the non-rotating second ring portion to an outer end connected to a bearing anchor point mounted on the engine block at an axially fixed position. Operation of the lift mechanism to selectively change the axial position of the first location of the second ring portion selectively changes the wobble plate angle θ and the axial distance d between the wobble plate pivot axis and a theoretical zero angle point, which in turn selectively changes the piston displacement of the engine while maintaining the compression ratio of the engine at a substantially constant value.

In one embodiment, the rotation-locking assembly is a constant velocity joint including an inner joint portion connected to the power shaft and having a plurality of radially outward facing races formed thereon, an outer joint portion connected to first ring portion of the wobble plate and having a plurality of radially inward facing races formed thereon, each race of the outer joint portion facing a corresponding race on the inner joint portion, and a plurality of race balls, each race ball captured between the corresponding inward facing and outward facing races of the respective joint portions.

In another embodiment, the bearing anchor point supporting the outer end of the axial anchor arm is mounted in a slider block and the slider block is slidingly mounted to the engine block to move in a radial direction along a normal line extending from the power shaft axis but is constrained against movement in the axial direction and constrained against movement in a circumferential direction around the power shaft axis.

In yet another embodiment, the bearing anchor point is mounted to the engine block at a fixed axial location, at a fixed radial distance from the power shaft axis and at a fixed circumferential location, and the outer end of the axial anchor arm includes a slot slidingly engaged over the bearing anchor point to allow sliding movement of the outer end of the axial anchor arm along the bearing anchor point.

In another aspect, a variable-displacement engine is provided comprising an engine block and an elongated power shaft rotatably supported by the engine block, the power shaft having a longitudinal axis defining an axial direction and being fixed axially relative to the engine block. A cylinder block is fixedly mounted to the engine block, the cylinder block defining at least one cylinder, each cylinder having a bore defining a bore axis aligned substantially parallel to the power shaft axis. One or more pistons are provided corresponding in number to the number of the cylinders, each respective piston being slidably disposed within the bore of a respective cylinder. One or more connecting rods are provided corresponding in number to the number of cylinders, each respective connecting rod having an upper end connected to a respective piston and a lower end connected to a respective connecting rod bearing. A wobble plate assembly has a generally annular configuration defining a central opening through which the power shaft passes, the wobble plate assembly including a non-rotating first ring portion, the first ring portion including one or more bearing mounting arms formed thereon, corresponding in number to the number of the connecting rods, each bearing mounting arm having a respective connecting rod bearing mounted thereon. A rotating second ring portion is provided, the second ring portion being rotatably slidably connected to the first ring portion so as to allow the second ring portion to rotate relative to the first ring portion about a common ring center line while constraining the second ring portion to remain parallel to the first ring portion. A rotation-locking assembly is connected between the first ring portion and the engine block to rotationally lock the first ring portion to the engine block while allowing the first ring portion to vary an angle of inclination with respect to the power shaft axis. The wobble plate assembly defines a wobble plate inclination plane being a plane passing through the centers of the connecting rod bearings, a wobble plate pivot axis being a line lying in the wobble plate inclination plane and intersecting the longitudinal axis of the power shaft in a perpendicular orientation and rotating with the power shaft, and a wobble plate angle θ being an angle of intersection between the wobble plate inclination plane and a plane normal to the power shaft axis when viewed in a direction parallel to the pivot axis. A piston control mechanism is provided including an anchor support member attached to the power shaft to rotate with the power shaft and extending radially outward from the power shaft to an outer end. A lift mechanism is slidably mounted on the power shaft for axial movement along the power shaft axis. A lever beam is supported at a first location by pivot bearings mounted to the lift mechanism along a normal line passing through the power shaft axis parallel to the wobble plate pivot axis and is supported at a second location by an axial anchor bearing carried by the anchor support member, thereby defining a lever beam centerline passing through the centers of the pivot bearing and the axial anchor bearing and an lever beam angle being an angle between the lever beam centerline and a plane normal to the power shaft axis when viewed in a direction parallel to the pivot axis. Two or more spaced-apart connecting links are provided, each connecting link having a first end connected to the second ring portion of the wobble plate and a second end connected to the lever beam. Operation of the lift mechanism to selectively change the axial position of the lever beam pivot bearings selectively changes the lever beam angle, which in turn selectively changes, via the connecting links, the wobble plate angle θ and the axial distance d between the wobble plate pivot axis and a theoretical zero angle point, which in turn selectively changes the piston displacement of the engine while maintaining the compression ratio of the engine at a substantially constant value.

In one embodiment, the rotation-locking assembly is connected to the engine block by a tubular support extending into the center of the wobble plate assembly.

In another embodiment, the rotation-locking assembly is a constant velocity joint including an inner joint portion connected to the tubular support and having a plurality of radially outward facing races formed thereon, an outer joint portion connected to first ring portion of the wobble plate and having a plurality of radially inward facing races formed thereon, each race of the outer joint portion facing a corresponding race on the inner joint portion, and a plurality of race balls, each race ball captured between the corresponding inward facing and outward facing races of the respective joint portions.

In yet another embodiment, the rotation-locking assembly is a constant velocity joint including an inner joint portion connected to the first ring portion of the wobble plate and having a plurality of radially outward facing races formed thereon, an outer joint portion connected to engine block surrounding the first ring portion and having a plurality of radially inward facing races formed thereon, each race of the outer joint portion facing a corresponding race on the inner joint portion, and a plurality of race balls, each race ball captured between the corresponding inward facing and outward facing races of the respective joint portions.

In a further embodiment, the outer end of the anchor support member forms a radially-oriented passageway, a block is slidingly mounted in the passageway, and the axial anchor bearing is mounted in the slider block to be movable in a radial direction along a normal line extending from the power shaft axis but constrained against movement in the axial direction and constrained to move in a circumferential direction around the power shaft axis with the anchor support member.

In another embodiment, the axial anchor bearing is fixedly mounted in the outer end of the anchor support member, and the outer end of the lever beam includes a slot slidingly engaged over the axial anchor bearing to allow sliding movement of the outer end of the lever beam along the anchor support bearing while being constrained to move in a circumferential direction around the power shaft axis with the anchor support member.

In yet another embodiment, the wobble plate assembly, connecting links and lever beam are configured to maintain the wobble plate inclination plane parallel to the centerline of the lever beam such that the wobble plate angle θ is equal to the angle of intersection between the lever beam centerline and a plane normal to the power shaft axis.

In still another embodiment, the wobble plate assembly, connecting links and lever beam are configured such that the wobble plate inclination plane is not parallel to the centerline of the lever beam, but changing the angle of intersection between the lever beam centerline and a plane normal to the power shaft axis changes the wobble plate angle θ.

In a further embodiment, the piston control mechanism is operatively connected to the wobble plate assembly to set the wobble plate inclination angle θ as the axial distance d between the position of the wobble plate pivot axis and a theoretical zero angle point changes so as to maintain a linear relationship between d and sin(θ) such that $d=K\cdot\sin(\theta)$, where K is a constant.

In a further aspect, a variable-displacement engine comprises an engine block, an elongated power shaft rotatably supported by the engine block, the power shaft having a longitudinal power shaft axis defining an axial direction and being fixed axially relative to the engine block. A cylinder block is fixedly mounted to the engine block, the cylinder block defining at least one cylinder, each cylinder having a bore defining a bore axis aligned substantially parallel to the power shaft axis. One or more pistons are provided corresponding in number to the number of the cylinders, each respective piston being slidably disposed within the bore of a respective cylinder. One or more connecting rods are provided corresponding in number to the number of cylinders, each respective connecting rod having an upper end connected to a respective piston and a lower end connected to a respective connecting rod bearing. A wobble plate assembly has a generally annular configuration defining a central opening through which the power shaft passes, the wobble plate assembly including a non-rotating first ring portion, the first ring portion including one or more bearing mounting arms formed thereon, corresponding in number to the number of the connecting rods, each bearing mounting arm having the respective connecting rod bearing mounted thereon, and a rotating second ring portion, the second ring portion being rotatably slidably connected to the first ring portion so as to allow the second ring portion to rotate relative to the first ring portion about a common ring center line while constraining the second ring portion to remain parallel to the first ring portion. A rotation-locking assembly is connected between the first ring portion and the engine block to rotationally lock the first ring portion to the engine block while allowing the first ring portion to vary an angle of inclination with respect to the power shaft axis. The wobble plate assembly defines a wobble plate inclination plane being a plane passing through the centers of the connecting rod bearings, a wobble plate pivot axis being a line lying in the wobble plate inclination plane and intersecting the longitudinal power shaft axis in a perpendicular orientation and rotating with the power shaft, and a wobble plate angle θ being an angle of intersection between the wobble plate inclination plane and a plane normal to the power shaft axis when viewed in a direction parallel to the pivot axis. A piston control mechanism includes an anchor support member attached to the power shaft to rotate with the power shaft and extending radially outward from the power shaft to an outer end, the outer end of the anchor support member forming a radially-oriented passageway wherein at least a portion of the passageway is non-perpendicular with respect to the power shaft axis. A slider block is slidingly mounted in the passageway and constrained to move along a path defined by the passageway. A lift mechanism is slidably mounted on the power shaft for axial movement along the power shaft axis. A lever beam is supported at a first location by pivot bearings mounted to the lift mechanism along a normal line passing through the power shaft axis parallel to the wobble plate pivot axis and is supported at a second location by an anchor bearing carried by the anchor support member, thereby defining a lever beam centerline passing through the centers of the pivot bearing and the anchor bearing and an lever beam angle being an angle between the lever beam centerline and a plane normal to the power shaft axis when viewed in a direction parallel to the pivot axis. One or more connecting links are provided, each connecting link having a first end connected to the second ring portion of the wobble plate and a second end connected to the lever beam. The anchor bearing is mounted in the slider block to be movable in a radial direction along the path defined by the passageway extending from the power shaft axis, the path having components in both the radial and axial directions and constrained to move in a circumferential direction around the power shaft axis with the anchor support member. Operation of the lift mechanism to selectively change the axial position of the lever beam pivot bearings selectively changes the lever beam angle, which in turn selectively changes, via the connecting links, the wobble plate angle θ and an axial distance d between the wobble plate pivot axis and a theoretical zero angle point, which in turn selectively changes the piston displacement of the engine while maintaining the compression ratio of the engine at a substantially constant value.

In one embodiment, the radially-oriented passageway of the anchor support member is oriented at a non-perpendicular angle β with respect to the power shaft axis such that the path of movement of the anchor bearing as the axial position of the lever beam pivot bearing changes is along a straight line intersecting the power shaft axis at the non-perpendicular angle β.

In another embodiment, the radially-oriented passageway of the anchor support member is curved such that the path of movement of the anchor bearing as the axial position of the lever beam pivot bearing changes is along a curved line.

In yet another embodiment, the radially-oriented passageway of the anchor support member is curved such that the path of movement of the anchor bearing as the axial position of the lever beam pivot bearing changes is along a circular path having a radius θ about a control point disposed adjacent to the power shaft axis.

BRIEF DESCRIPTION OF THE DRAWINGS

For a more complete understanding, reference is now made to the following description taken in conjunction with the accompanying drawings, in which:

FIG. 6-*a* is a schematic side view of an engine in accordance with another aspect illustrating the geometry of the engine reference plane;

FIG. 6-*b* is a schematic view of gear tooth profiles illustrating one embodiment of the anti-rotation assembly;

DETAILED DESCRIPTION

Figure 1:
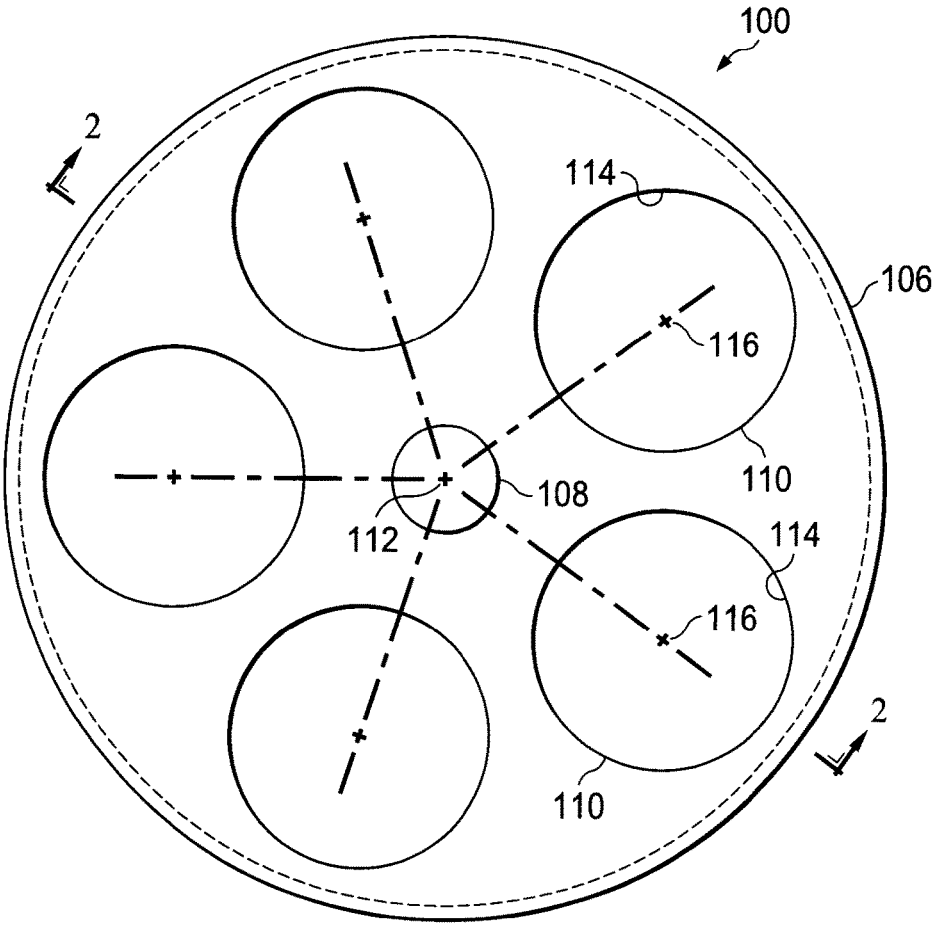
FIG. 1 is a simplified cross-sectional top view of an engine according to one embodiment taken along line 1-1 of FIG. 2.

Referring now to the drawings, wherein like reference numbers are used herein to designate like elements throughout, the various views and embodiments of continuously variable displacement engine are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Description of a First Exemplary Embodiment

Figure 2:
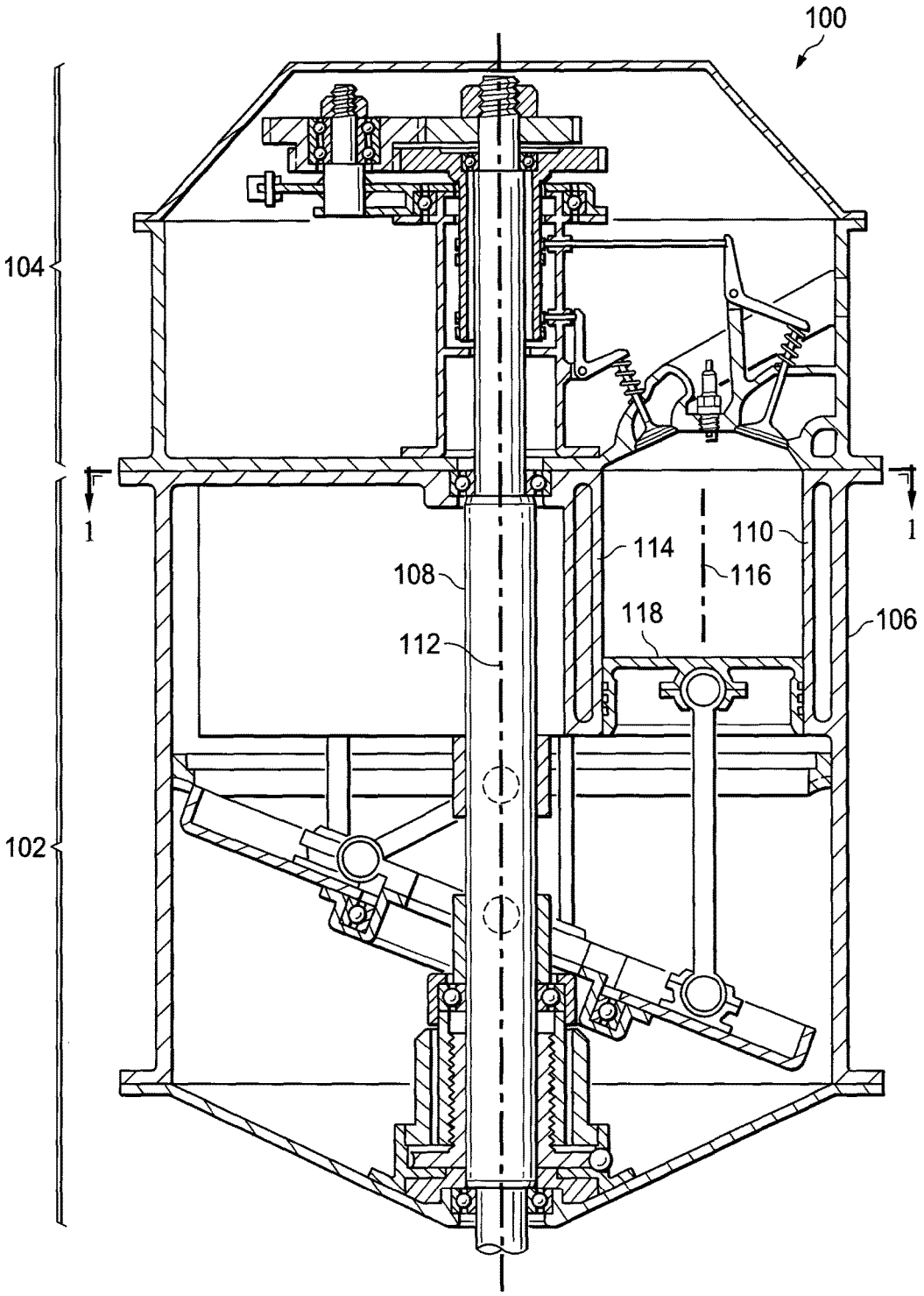
FIG. 2 is a cross-sectional side view of the engine of FIG. 1 taken along line 2-2 of FIG. 1.
Figure 3:
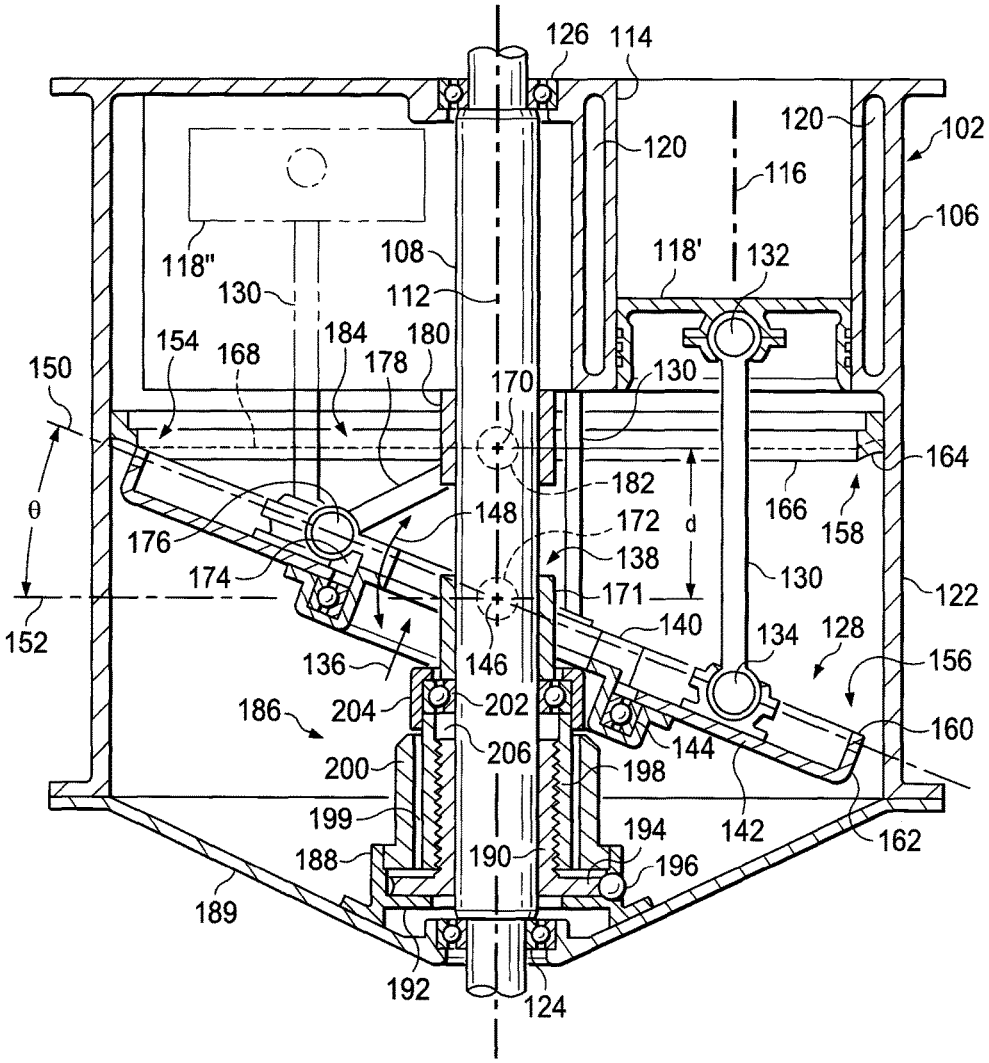
FIG. 3 is a cross-sectional side view of the engine block portion of the engine of FIG. 2.
Figure 4:
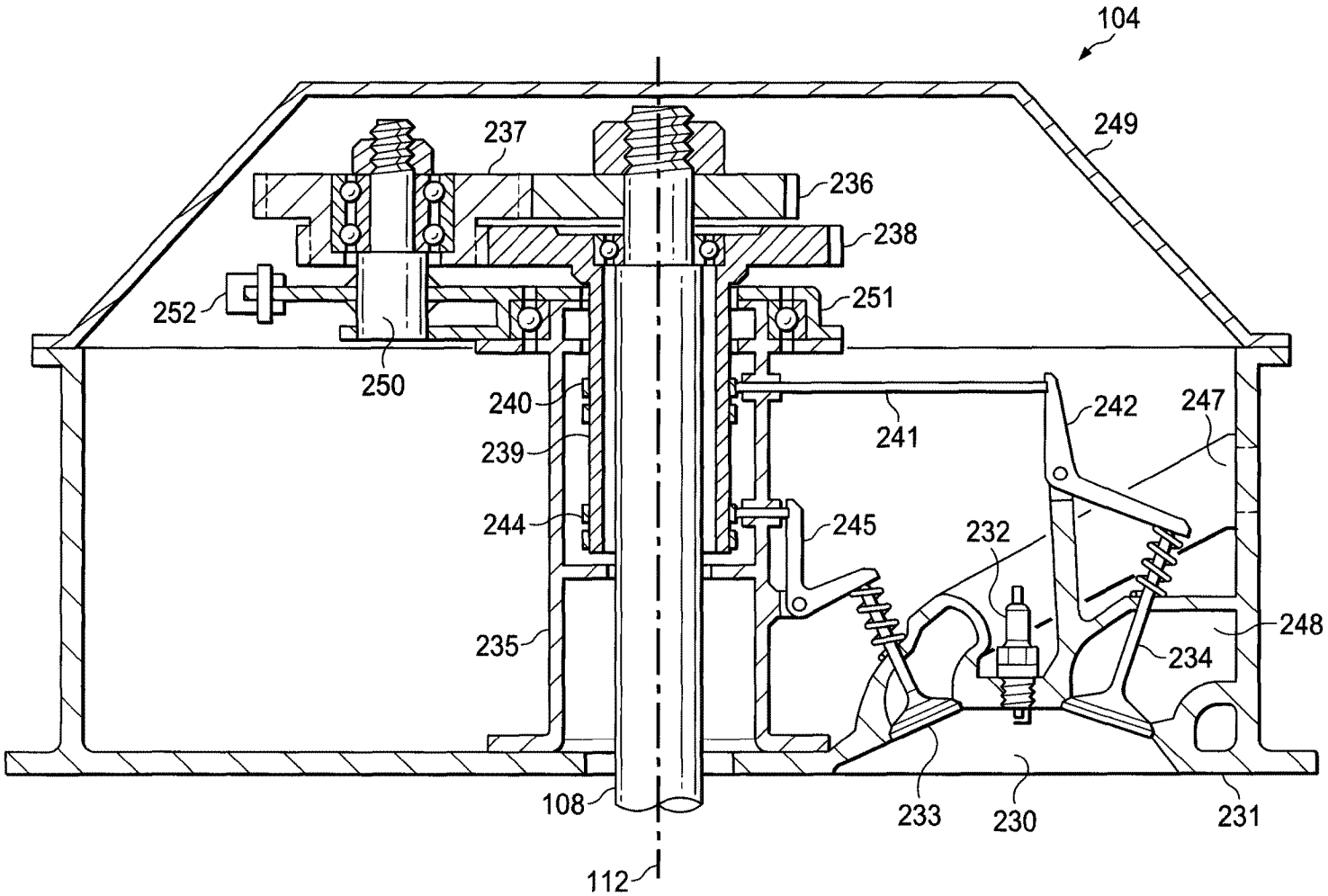
FIG. 4 is a cross-sectional side view of the cylinder head portion of the engine of FIG. 2.

Referring to FIGS. 1-4, there is illustrated a variable displacement engine 100 in accordance with a first exemplary embodiment of the invention. FIG. 1 provides a simplified cross-sectional top view of the engine 100, FIG. 2 provides an overall cross-sectional side view of the engine 100, FIG. 3 provides a cross-sectional side view of the engine block assembly 102 including the cylinders, power shaft and piston control mechanism and FIG. 4 shows the cylinder head assembly 104 and its internal components.

Referring now specifically to FIG. 1, engine 100 comprises an engine block 106, a power shaft 108 rotatably supported by the engine block and at least one cylinder 110 supported by the engine block. The elongated power shaft 108 defines a longitudinal axis 112 running through both the power shaft and the engine block 106. Each cylinder 110 has a bore 114 defining a bore axis 116 aligned substantially parallel to the longitudinal axis 112 of the power shaft 108. The engine 100 illustrated in FIG. 1 has five cylinders 110 evenly spaced around the central shaft 108; however, other embodiments of the engine may have different numbers of cylinders (including a single cylinder) and/or have the cylinders spaced differently around the power shaft.

Referring now also to FIG. 2, the illustrated engine 100 is configured with the cylinder head assembly 104 mounted on top of the engine block assembly 102. In the illustrated embodiment, the power shaft 108 extends from the engine block assembly 102 into the cylinder head assembly 104; however, in other embodiments of the engine the power shaft may be differently arranged. A piston 118 is slidably disposed within the bore 114 of each respective cylinder 110.

Referring now to FIG. 3, the engine block assembly 102 is illustrated in more detail. The engine block 106 (also called the "cylinder block") is the major support structure for the internal components and may include coolant passages 120 for the cylinders 110. An outer wall 122 of the cylinder block 106 may have a cylindrical configuration for structural efficiency. The power shaft 108 may be mounted in the cylinder block 106 by bearings 124 and 126. The pistons 118 are attached to a non-rotating portion of a ring-like wobble plate assembly 128 by connecting rods 130. In FIG. 3, three of the connecting rods 130 are visible. Spherical connecting rod bearings 132 and 134 are provided at the respective upper and lower ends of each connecting rod 130 to permit the necessary freedom of relative motion for the connected components. In FIG. 3, one piston (denoted 118') is illustrated at the bottom of its stroke, and another piston (denoted 118", shown partially in hidden line) is illustrated near the top of the stroke.

The wobble plate assembly 128 has a generally annular (i.e., ring-like) configuration defining a central opening 136. In the illustrated embodiment, the power shaft 108 passes through the central opening 136. The wobble plate assembly 128 includes a central support member 138, a first ring portion 140, a second ring portion 142 and a ring bearing assembly 144. The central support member 138 is longitudinally slidably mounted on the power shaft 108, but rotates around the longitudinal axis 112 with the power shaft. The central support member 138 defines a pivot axis 146 for the wobble plate assembly 128. The pivot axis 146 intersects the longitudinal axis 112 in a perpendicular orientation and also rotates with the power shaft 108. The first ring portion 140 is pivotally mounted on the central support member 138 such that the first ring portion 140 pivots (as denoted by arrow 148) about the pivot axis 146; however, the first ring portion also rotates around the longitudinal axis 112 with the central support member 138 and the power shaft 108. The second ring portion 142 is concentrically disposed adjacent the first ring portion 140. Mounted on the second ring portion 142 are the lower connecting rod bearings 134. As will be further described herein, the second ring portion 142 does not rotate around the longitudinal axis 112 with the power shaft 108. The ring bearing assembly 144 is connected between the first ring portion 140 and the second ring portion 142 so as to allow the first ring portion to rotate about the common center relative to the second ring portion while constraining the second ring portion to remain parallel with the first ring portion.

Referring still to FIG. 3, the wobble plate assembly 128, when viewed in a direction parallel to the pivot axis 146, defines a wobble plate inclination plane (denoted by reference number 150) and a wobble plate inclination angle θ. When viewed in a direction parallel to the pivot axis 146, the wobble plate inclination plane 150 is seen as a line passing through the center of the pivot axis 146 and the center(s) of the lower connecting rod bearings 134; however, that line corresponds to the edge of the wobble plate plane 150 collectively defined by the centers of the lower connecting rod bearings 134. The wobble plate inclination angle θ is the angle of intersection between the wobble plate inclination plane 150 and a plane (denoted by reference number 152) perpendicular to the longitudinal axis 112 of the power shaft 108, when viewed parallel to the pivot axis. As will be further described herein, the wobble plate inclination angle θ determines the engine displacement (also called "piston displacement") of the engine 100 for each full rotation of the power shaft 108.

As previously described, the second ring portion 142 of the wobble plate assembly 128 does not rotate with the power shaft 108. Rotation of the second ring portion 142 is prevented by an anti-rotation assembly 154 having a first anti-rotation portion 156 operatively connected to the second ring portion and a second anti-rotation portion 158 operatively connected to the engine block 106. In the embodiment of FIG. 3, the first anti-rotation portion 156 includes a first plurality of teeth 160 disposed on the outer rim 162 of the second ring portion 142, and the second anti-rotation portion 158 includes a second plurality of teeth 164 disposed on a stationary ring gear 166 fixedly mounted on the engine block 106. In the illustrated embodiment, the engagement of the teeth 160 and 164 occurs substantially where the wobble plate inclination plane 150 intersects a control plane (denoted by reference number 168), the control plane 168 being a plane oriented perpendicular to the longitudinal axis 112 positioned at the theoretical zero displacement point (denoted by reference number 170). Determination of the position of the theoretical zero displacement point 170 is further described herein, e.g., in relation to FIG. 5. That the intersection of teeth 160 and 164 may occur in the control plane 168 and at the same distance from the center of the second ring portion 142 is further described below. As the power shaft 108 rotates, the highest part the second ring portion 142 remains continuously engaged with the ring gear 166 and prevents the second ring portion from rotating relative to the engine block 106. It will be appreciated that the teeth 160 and 164 may have non-standard profile(s) so as to accommodate differences in the pitch of the teeth of outer rim 162 and gear 166. The tooth profiles may also need to accommodate the change in angle and radial location of the outer rim 162 as the wobble plate inclination angle θ changes to vary piston displacement. An example of gear tooth configurations to accommodate the difference in tooth pitches is described in connection with FIG. 6-*b*.

Referring still to FIG. 3, the non-rotating second ring portion 142 of the wobble plate assembly 128 is attached by the ring bearing assembly 144 to the first ring portion 140, which rotates with the power shaft 108 as previously described. The first ring portion 140 is pivotally attached to the central support member 138 defining the pivot axis 146.

In the illustrated embodiment, the central support member 138 includes a support collar 171 and two pivot bearings 172, one disposed on each side of the support collar along the pivot axis 146. The support collar 171 is permitted to slide axially (i.e., longitudinally) along the power shaft 108. A short arm 174 mounted on the first ring portion 140 extends to a control bearing 176, which in turn connects the first ring portion to one end of a control link 178. The other end of the control link 178 is attached to an upper collar 180 by two upper bearings 182, one on each side of the upper collar. In the illustrated embodiment, the upper bearings 182 are disposed on the longitudinal axis 112 at the theoretical zero displacement point 170. Upper collar 180 is attached firmly to the power shaft 108 to prevent movement axially and relative rotation about the power shaft. The control link 178 assures that the first ring portion 140 rotates with the drive shaft 108.

The control link 178 between bearings 182 and 176 together with the first ring portion 140 between bearings 176 and 172 forms a three point linkage comprising a piston control linkage 184 for the illustrated embodiment. The piston control linkage 184 changes the wobble plate inclination angle θ as the pivot axis 146 moves along the longitudinally axis 112 so as to maintain a constant compression ratio independent of engine displacement. The specific dimensions and/or positions of the elements making up the piston control linkage 184 may be determined by considering the minimum desired combustion chamber volume (i.e., with the pistons 118 at maximum upward travel), piston diameter, maximum wobble plate inclination angle, and the distance from the longitudinal axis 112 (i.e., center of power shaft 108) to the lower connecting rod bearings 134. An example of this determination is described in connection with FIG. 5.

It will be appreciated that the configuration of the piston control linkage may be different in other embodiments. However, regardless of the configuration, the piston control linkage produces a constant compression ratio independent of engine displacement by maintaining a linear relationship between a distance d and sin(θ) as the pivot axis 146 moves, where d is the distance (measured along the longitudinal axis 112) between the location of the pivot axis 146 and the theoretical zero displacement point 170, and θ is the wobble plate inclination angle. Put another way, the piston control linkage ensures that 0 and d change simultaneously such that $d=W\cdot\sin(\theta)$, where W is a constant. This relationship assures that the compression ratio is independent of engine displacement, as further illustrated and described in connection with FIG. 5.

Referring still to FIG. 3, the piston displacement of the engine 100 may be varied by moving the pivot axis 146 of the wobble plate assembly 128 axially along the power shaft 108 using a displacement actuator 186. In the illustrated embodiment, the displacement actuator 186 is a screw jack device and the pivot axis 146 is carried by the support collar 171; however, the configuration of these elements may be different in other embodiments. The displacement actuator 186 surrounds the power shaft 108 and is mounted on a base 188 to a lower cover 189 of the engine block 106. An inner member 190 of the actuator surrounds the power shaft 108 and has external threads. The bottom of the inner member 190 is restrained by a thrust ring 192 that is part of the base 188. A lower flange 194 of the inner member 190 includes an external gear that is operatively engaged by a screw gear 196 to selective rotate the inner member in order to operate the screw jack and vary the engine displacement. The inner member 190 threadingly engages an internally threaded lift cylinder 198. The lift cylinder 198 is restrained from rotating by tines or other restraining elements (not shown) that mate with an external housing 200. The housing 200 is firmly attached to the base 188, and the base of the housing also restrains the inner member 190 so that it does not lift off the base 188. The lift cylinder 198 acts against a lift bearing 202. An outer collar 204 retains the lift cylinder 198 to the lift bearing 202. The lift bearing is also attached to support collar 171 by an internal collar 206, which is attached to an extension of the support collar that passes through the inside of the lift bearing. The upper collar 180 and the lift cylinder 198 of the screw jack device 186 also serve as mechanical stops to limit the range of engine displacement.

Referring now to FIG. 4, the cylinder head assembly 104 of this embodiment is illustrated in more detail. The cylinder head assembly 104 includes a cylinder head 231 that attaches to the engine block assembly 102 (shown in FIG. 2) and defines one or more head cavities 230 to enclose the area above each cylinder 110 of the engine block. For purposes of clarity, the valves and porting structure corresponding to only one cylinder 110 (e.g., for cylinder 1) are shown in FIG. 4. The hardware for the remaining cylinders 110 (e.g., for cylinders 2, 3, 4 and 5) is similar and spaced around the power shaft 108 in a similar manner to the cylinders shown in FIG. 1. The ignition device 232, intake valve 233 and exhaust valve 234 are located in the top of the combustion chamber.

A cam support structure 235 is attached to the cylinder head 231 concentric to the power shaft 108. In this embodiment, cam reduction gears 236, 237, and 238 are provided to synchronize the rotation of a cam body 239 with the rotation of the power shaft 108 and reduce the rotation rate of the cam body to one-half the rotation rate of the power shaft as required for a 4-stroke engine. A first cam 240 depresses the exhaust valve 234 for the first cylinder through a push rod 241 and a rocker arm 242. A second cam 244 depresses the intake valve 233 for the first cylinder through a rocker arm 245. Corresponding intake and exhaust valves, cams and actuating linkages (not shown) are provided for the remaining cylinders, but are not illustrated in FIG. 4 for purposes of clarity.

During engine operation a fuel/air mixture enters the cylinder head 231 through an intake port 247. Exhaust gases are discharged through an exhaust port 248. The top of the cylinder head assembly is enclosed by a valve cover 249.

In the illustrated embodiment, the valve timing may be varied by rotating the position of the cam reduction gear 237 around the power shaft 108. The cam reduction gear 237 is mounted on a support structure 250. A bearing 251 permits the support structure 250 with the cam reduction gear 237 to rotate about the support structure 235 and the power shaft 108. Rotation of the support structure 250 may be controlled by an external actuator 252.

Design Process Example

As previously indicated, the details of a mechanism suitable to maintain a constant pressure ratio in an internal combustion engine having a variable displacement depend on several design parameters. An example is now provided to demonstrate the process of calculating the design details for a particular embodiment. This design process example is based on estimated parameters (not optimized) for a gasoline fueled engine with five cylinders and a compression ratio of 4.804 (i.e., pressure ratio of 9.00). The selected pistons and cylinders are 4.00 inches in diameter. The selected distance from the power shaft centerline to the piston/cylinder centerline is 4.00 inches.

The selected range of variable displacement of the example design is to allow the engine to operate within a range between a maximum displacement DPmax of 3.0 liters and a minimum displacement DPmin of 1.0 liter, i.e., the "size" of the engine at minimum displacement being ⅓ the size of the engine at the maximum displacement. For the engine operating at the DPmin displacement of 1.0 liter, each piston displacement is calculated to be 12.205 cubic inches, and the corresponding piston stroke is calculated to be 0.971 inches. The required combustion chamber volume at the top of the piston stroke is 3.208 cubic inches (with the top of the piston assumed to be in the same plane as the bottom of the cylinder head).

For the engine operating at the DPmax displacement of 3.0 liter, with a piston diameter unchanged at 4.00 inches, the required displacement of each piston is 36.615 cubic inches, and the corresponding stroke for each piston is calculated to be 2.914 inches. The required combustion chamber volume of each cylinder head with the piston at the top of the compression stroke is calculated to be 9.625 cubic inches. Since the combustion chamber volume of the head is only 3.208 cubic inches when the piston top is level with the bottom of the cylinder head (as assumed in the previous step), an additional combustion chamber volume of 6.417 cubic inches must be provided by lowering the top of the piston stroke to 0.511 inches below the cylinder head.

Figure 5:
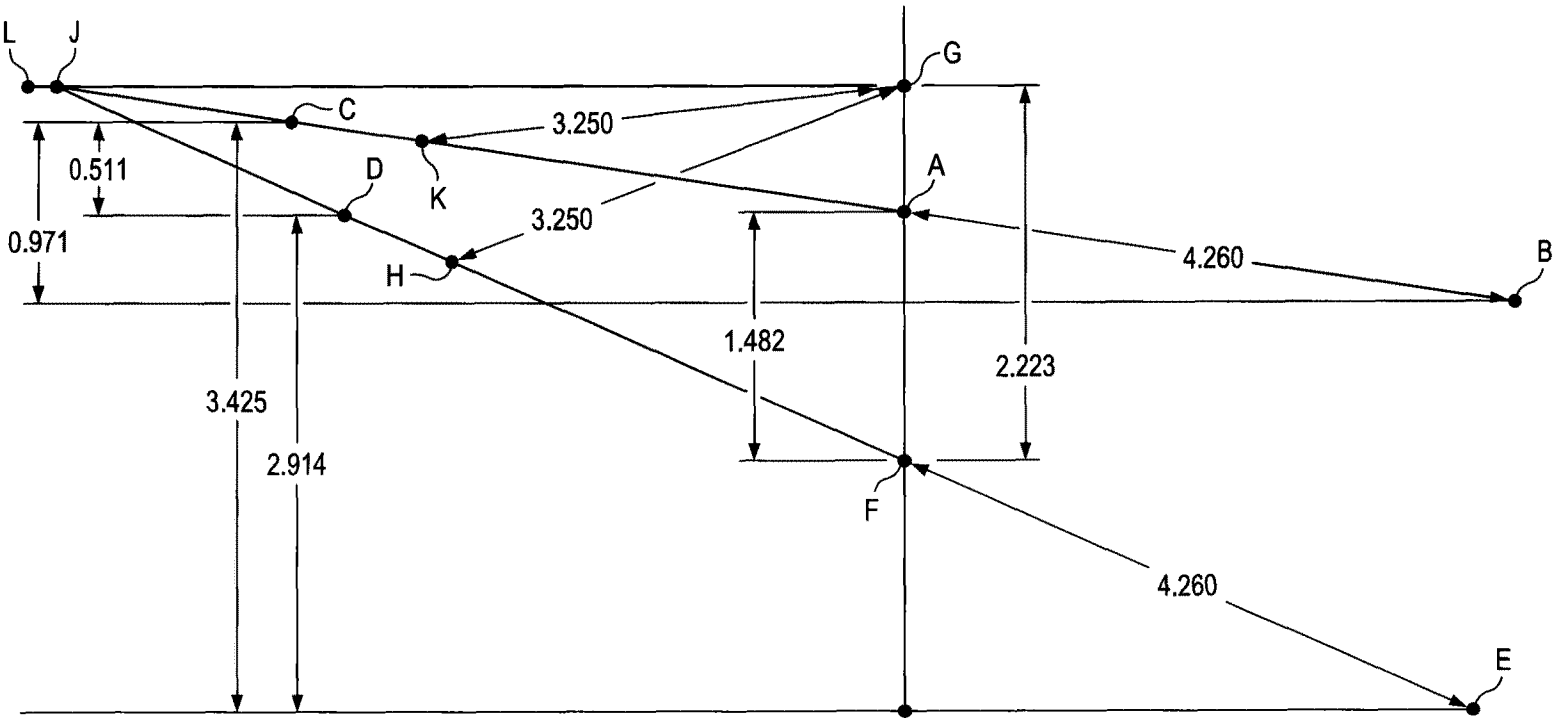
FIG. 5 is a schematic side view of an engine in accordance with another aspect illustrating the geometry of the wobble plate assembly at different values of displacement.

Referring now to FIG. 5, a schematic diagram is provided of the engine 100 of FIGS. 1-4 depicting primarily the power shaft and wobble plate assembly. FIG. 5 shows how the displacement/compression ratio control mechanism (also called the piston control mechanism) described in connection with FIGS. 1-3 achieves the required characteristics for the design process example. The reference numbers from FIGS. 1-3 are used to refer to the corresponding features of FIGS. 1-3.

Point A in FIG. 5 represents the location of the pivot axis 146 (i.e., the center of the pivot bearing 172) on the sliding collar 171 for the engine operating at the minimum piston displacement (DPmin) of 1.0 liter. This location, at the centerline of power shaft 108 (shown by line G-A-F), is selected so that there will be no interference between the parts of the piston control mechanism and the fixed parts of the cylinder block 106. As previously described, the support collar 171 slides along the power shaft 108, thereby moving the pivot bearing 172 to vary the engine displacement. At the (DPmin) 1.0 liter level of engine displacement, the stroke of each piston is 0.971 inches. The location of the center of connecting rod lower bearing 134 at the bottom of the piston stroke (i.e., when the section of the wobble plate directly under the rod bearing is lowest) is shown as point B, and the location of the same rod bearing at the top of the piston stroke (i.e., when the section of the wobble plate directly under the rod bearing is highest) is shown hypothetically as point C. The line through points B and C thus represents the wobble plate plane 150 passing through the centers of the connecting rod lower bearings 134 on the second ring portion in FIG. 3 with the engine operating at 1.0 liter engine displacement. It will be appreciated that in actuality, point C for each cylinder occurs directly above point B after the power shaft/first ring portion of the piston control mechanism has rotated 180 degrees, but for purposes of explanation and illustration it is it represented at the opposite end of the wobble plate line. It was previously assumed that, when the piston is at the top of the stroke for the engine at the 1.0 liter engine displacement, the top of the piston is in the same plane as the bottom of the cylinder head and the combustion chamber volume is 3.208 cubic inches. Since point A is midway between points B and C, the distance between the center of pivot bearing 172 and rod bearing 134 (e. g. points A and B for the 1.0 liter operating level) is always 4.260 inches. Angle G-L-A, which is the angle of inclination θ of the wobble plate line 150 with respect to the plane 152 normal to the centerline of power shaft 108, is calculated to be 6.55 degrees at 1.0 liter engine displacement.

Referring still to FIG. 5, the piston stroke for the engine operating at the (DPmax) 3.0 liter engine displacement level requires a piston stroke of 2.914 inches. For the engine to maintain a constant pressure ratio, the combustion chamber volume at the top of piston stroke is required to be 9.625 cubic inches. As explained earlier, a combustion chamber volume of 9.625 cubic inches requires that the top of the piston stroke be 0.511 inches below the top of the cylinder. Thus, the hypothetical location of rod bearing 134 at the top of the stroke for the 3.0 liter engine displacement is shown in FIG. 5 as point D. Adding the required piston stroke length of 2.914 inches gives the rod bearing 134 location at the bottom of the stroke, which is shown as point E. The location of the pivot bearing 172 at the 3.0 liter operating level is shown as point F. The angle G-J-F, which is also the angle of inclination θ of the wobble plate line 150 with respect to the plane 152 normal to the centerline of power shaft 108 at the 3.0 liter engine displacement, is 20.00 degrees.

Accordingly, the distance between point A and point F is 1.482 inches, and this is the distance that support collar 171/pivot axis 146 must travel for the engine displacement to go from 1.0 liter to 3.0 liters engine displacement while maintaining a constant compression ratio. A linear relationship between collar travel and engine displacement results in a hypothetical location of bearing pivot axis at point G, i.e., 2.223 inches above point F, that will produce zero displacement. This location is also known as the theoretical zero displacement point 170.

A mechanism can now be defined that will maintain constant compression ratio as engine displacement is varied between DPmin of 1.0 liters and DPmax of 3.0 liters. Using the 3.0 liter operating level for analysis, a straight line passing through points D and E represents a plane in the non-rotating second ring portion 142 and the rotating first ring portion 140 in FIG. 3. A control link 178 is therefore constructed between the upper bearing 182 on the upper collar 180 and the control bearing 176 on the first ring portion 140. The center of the upper bearing 182 is located at point G, and point H represents the center of the control bearing 176 of the control link 178. The location of point H on the line between point D and point E is determined by drawing a line from point G to point H so that the angle H-F-G is the same magnitude as angle H-G-F. By similarity, the distance from point G to point H is the same as the distance from point F to point H, which is 3.250 inches. If the line between point E and point D is extended an additional distance of 3.250 inches from point H to point J, it can be shown by similarity that point J lies on a plane perpendicular to the centerline of power shaft 108 that passes through point G.

If the support collar 171 moves along the power shaft 108 so that the center of bearing 172 (i.e., the pivot axis 146) moves from point F to point A (engine at the 1.0 liter engine displacement), then the linkage similarity relationships still holds, thereby demonstrating that the engine maintains a constant compression ratio. It should also be noted that if the line between points B and C is extended from point K by the same distance as the distance between points A and K to point L, then point L lies on the same line perpendicular to the power shaft as points G and J. This relationship supports the design concept for gears 160 and 166 described in connection with FIG. 3, and further is the basis for an alternate piston control mechanism (Variation 7) described in connection with FIG. 13.

Referring now to FIGS. 6-*a* and 6-*b*, the tooth profiles to accommodate different tooth pitch in the anti-rotation assembly 154, e.g., outer rim teeth 160 and the ring gear 166, in FIG. 3 are calculated using the previously defined engine design parameters that serve as a basis for design process example. An example of tooth profiles that will meet the requirement for different tooth pitches in parts 160 and 166 are derived in the following description. The derivation is illustrated in FIGS. 6-*a* and 6-*b* for the engine operating at 3.0 liters piston displacement as shown in FIG. 3.

Referring first to FIG. 6-*a*, a first imaginary circular plane (denoted A) passing through the centers of the pivot bearing 172 and the control bearing 176 in FIG. 3 is shown. A second circular plane (denoted B) is perpendicular to the power shaft axis 112 (denoted C) and passes through the center of upper bearing 182. The point of intersection (denoted D) of these two planes A and B represents the reference plane for engagement of the teeth on parts 160 and 166 in FIG. 3. The distance from point D to the power shaft centerline C defines the radii of planes A and B. The point of intersection D traverses a complete circle normal to the power shaft axis 112 as the power shaft 108 rotates one turn.

Referring still to FIG. 6-*a*, the first circular plane A is inclined 20 degrees with respect to the second circular plane B. For the baseline 3.0 liter engine of this example, the radius of the first plane A is 6.50 inches and the radius of the second plane B is 6.0 inches. In order for the angle of rotation for the non-rotating second ring portion 142 to be zero, the point of intersection (for the planes A and B) traverses a circle at the same rotational speed as the power shaft 108. The edge of the first plane A thus represents the line of contact for the gear teeth 160 on the rim 162 of the second ring portion 142 and the edge of plane B represents a line of contact for teeth 164 on the ring gear 166. There must be the same number of teeth on the outer rim 162 and the ring gear 166. For this example each "gear" has 60 teeth (one every 6 degrees) and a total height of 0.2 inches (contact line+/−0.1 inches.) The requirement for equal number of teeth means that the tooth pitch on the outer rim 162 and the ring gear 166 are not the same. Such operation is possible only if the differences in tooth pitch are small and the number of teeth engaged at any one time is also sufficiently small. The example given here is for the maximum difference in radii for the outer rim 162 and the ring gear 166, which occurs at the maximum cylinder displacement as illustrated.

Referring now also to FIG. 6-*b*, compatible tooth profiles for the teeth on the outer rim 162 and the ring gear 166 were calculated by comparing the tooth locations near the contact point of planes A and B (of FIG. 6-*a*). A tooth profile is assumed for one set of teeth. The tooth profile for the second set of teeth can then be calculated. The reference points for this calculation were the center of each tooth tip in the region of interaction between the teeth near the point of intersection D of the two planes A and B. The analysis was accomplished with the tip of the outer rim 162 tooth assumed to be circular with a radius of 0.1 inches (not optimized). The required profile for the teeth on ring gear 166 was calculated as a function of the distance from the point of intersection. The results in a plane normal to and adjacent to the edge of plane B are shown in FIG. 6-*b*. The sides of the teeth on ring gear 166 are defined by the motion of the circular tips of the non-rotating outer rim 162 teeth. The base of the teeth on outer rim 162 only have to be narrow enough to not interfere with the sides of the teeth on ring gear 166.

As the power shaft turns and the contact point progresses to the right, more teeth are engaged to the right of the illustration and an equal number of teeth are disengaged in the left portion of the illustration. Since there are the same number of teeth on outer rim "gear" 162 and ring gear 166, the point of contact rotates with the same angular rate as the power shaft even though the radii of the ring gear 166 and outer rim gear 162 are not the same. This relationship assures that the outer rim gear 162 (and thus, the second ring portion 142 of the wobble plate assembly) does not rotate.

Variations to the First Exemplary Embodiment

Although a first example embodiment of the apparatus, method and system of the present invention has been illustrated in the accompanied drawings and described in the foregoing detailed description, it is understood that other variations, numerous rearrangements, modifications and substitutions can be made without departing from the spirit and the scope of the invention as presented.

Additional embodiments are now presented, wherein variations to the first example embodiment are described

Variation One—Use of a Hydraulic Piston to Vary Displacement

Figure 7:
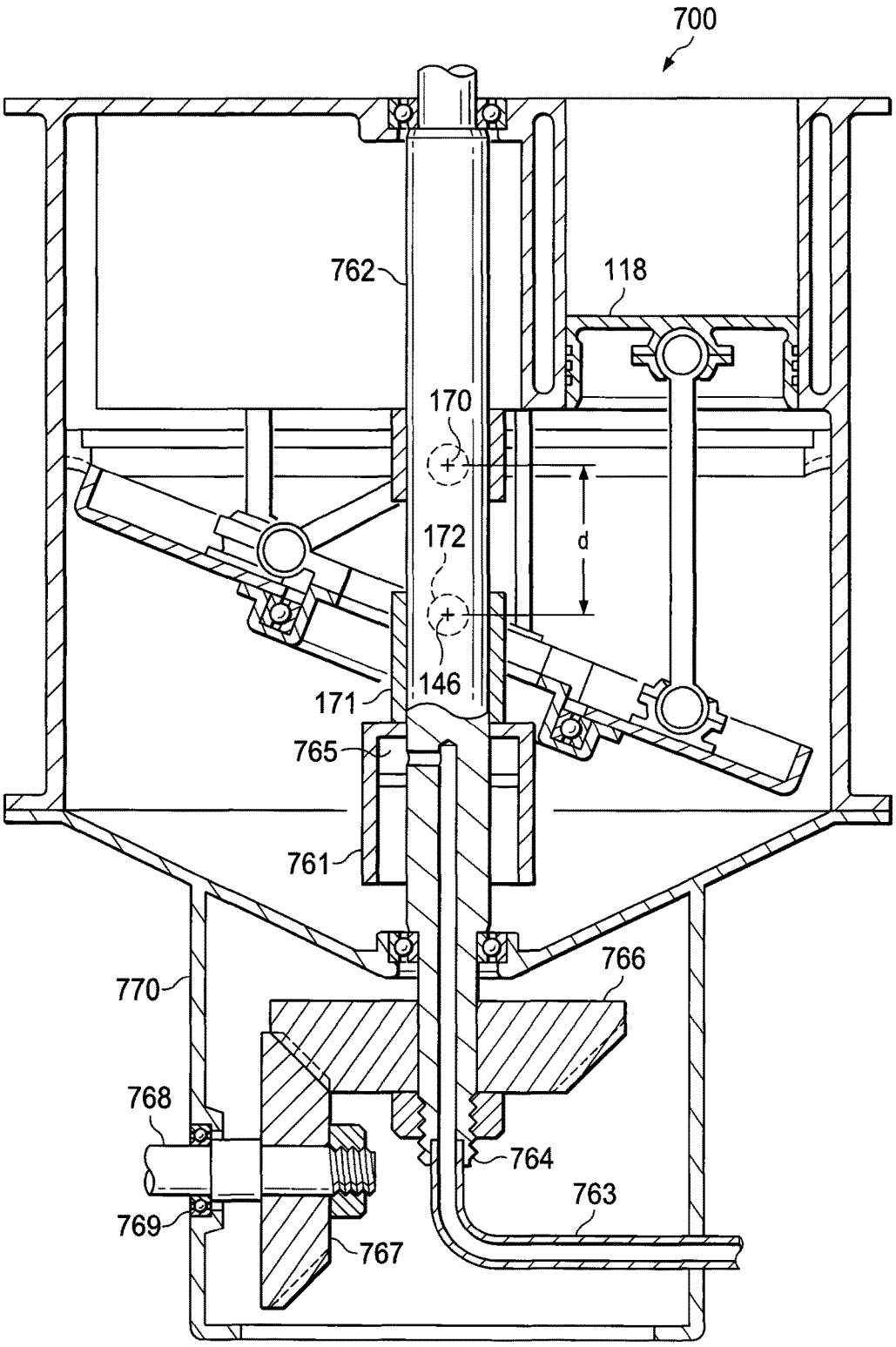
FIG. 7 is a cross-sectional side view of an engine block portion of an engine according to another embodiment ("first variation") illustrating aspects of a hydraulic displacement actuator.

Referring now to FIG. 7, there is illustrated an alternative variable displacement engine 700 similar in many respects to the engine 100 described in connection with FIGS. 1-4. Only the elements that differ substantially from those describe in FIGS. 1-4 are renumbered.

Variable displacement engine 700 includes a displacement actuator comprising a hydraulic piston 761, rather than the mechanical screw jack mechanism shown in FIG. 3. The piston 761 moves the support collar 171 and pivot bearing 172 in the axial direction along the modified power shaft 762 to increase or decrease the engine displacement. In the embodiment illustrated, the natural forces of pressure on the pistons 118 move the piston control mechanism down to increase displacement. To move the pistons upward and decrease displacement, high-pressure hydraulic fluid flows through the supply tube 763, through a rotary seal 764, through a passage in the power shaft 762 and into the upper cavity of the piston 765. If the fluid supply valve closes so that hydraulic fluid flow is prevented, then the piston 761 remains stationary and the engine displacement is constant. The hydraulic fluid supplied to the piston 761 is regulated by a mechanical and/or electronic engine control.

The fluid enters the power shaft 762 at the bottom end so that the high pressure fluid seal will be as small as possible and the passage in the power shaft is reasonably short. Bevel gears 766 and 767 provide a means to transmit power from the power shaft 762 to a location outside of the engine. Bevel gear 767 is supported by drive shaft 768 and bearing 769. The bearing 769 is supported by an extension of the lower block cover 770.

Variation Two—Replacement of Cams with Hydraulically Driven Valve Actuators

Figure 8:
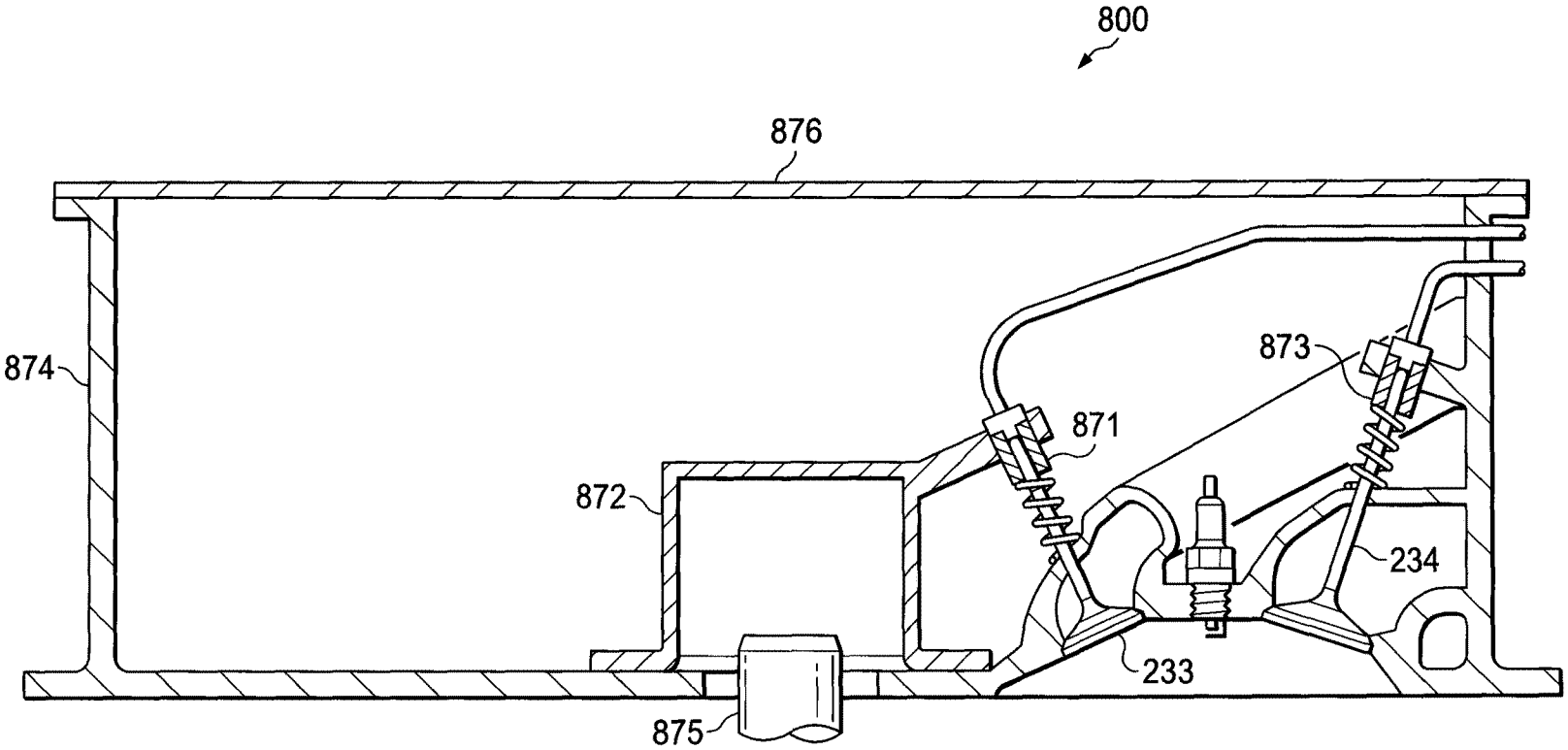
FIG. 8 is a cross-sectional side view of a cylinder head portion of an engine according to another embodiment ("second variation") illustrating aspects of hydraulic valve actuators.

Referring now to FIG. 8, there is illustrated an alternative variable displacement engine 800 similar in many respects to the engine 100 described in connection with FIGS. 1-4. Only the elements that differ substantially from those describe in FIGS. 1-4 are renumbered.

Variable displacement engine 800 includes hydraulically driven actuators for operation of the intake valves 233 and the exhaust valves 234. A hydraulic actuator 871 opens intake valve 233 for piston 1. A similar actuator is required for each of the remaining intake valves, but these are not shown for clarity. The actuator 871 is held in place by support structure 872. A hydraulic actuator 873 opens the exhaust valve 234 for piston 1. Similar actuators operate the remainder of the exhaust valves. The actuators 873 are supported by extensions from a modified cylinder head 874. The cylinder head 874 is the same as cylinder head 231 in FIG. 4 except for addition of the supports for exhaust valve actuators 873 and deletion of supports for exhaust valve rockers 242 in FIG. 3. High pressure hydraulic fluid used to operate the hydraulic actuators is scheduled by a mechanical and/or electronic engine control. This type of valve operation permits variation in valve timing, valve travel, valve open time and rate at which the valves open and close.

As noted by a comparison of FIG. 8 and FIG. 4, the use of hydraulic valve actuators 871, 873 may greatly reduce the number of parts and complexity of the mechanism contained in the cylinder head of an embodiment which uses cams for valve actuation. The extension of the power shaft 108 into the head is no longer necessary and a shortened power shaft 875 is shown in FIG. 8. A flat head cover 876 is shown in FIG. 8 rather than the domed design 249 shown in FIG. 4.

Variation Three—Use of Hydraulic Actuation for Both Displacement Actuator (Piston Control Mechanism) and Valve Operation This variation (not shown) combines the features of engines 700 and 800. All actuators, e.g., 761, 871 and 873, may use the same source of high pressure hydraulic fluid and/or may be scheduled by a mechanical and/or electronic engine control.

Variation Four—Use of Slots and Sliding Mechanism to Control Connecting Rod Motion Referring now to FIG. 9, there is illustrated an alternative variable displacement engine 900 similar in many respects to the engine 100 described in connection with FIGS. 1-4. Only the elements that differ substantially from those describe in FIGS. 1-4 are renumbered.

Figure 9:
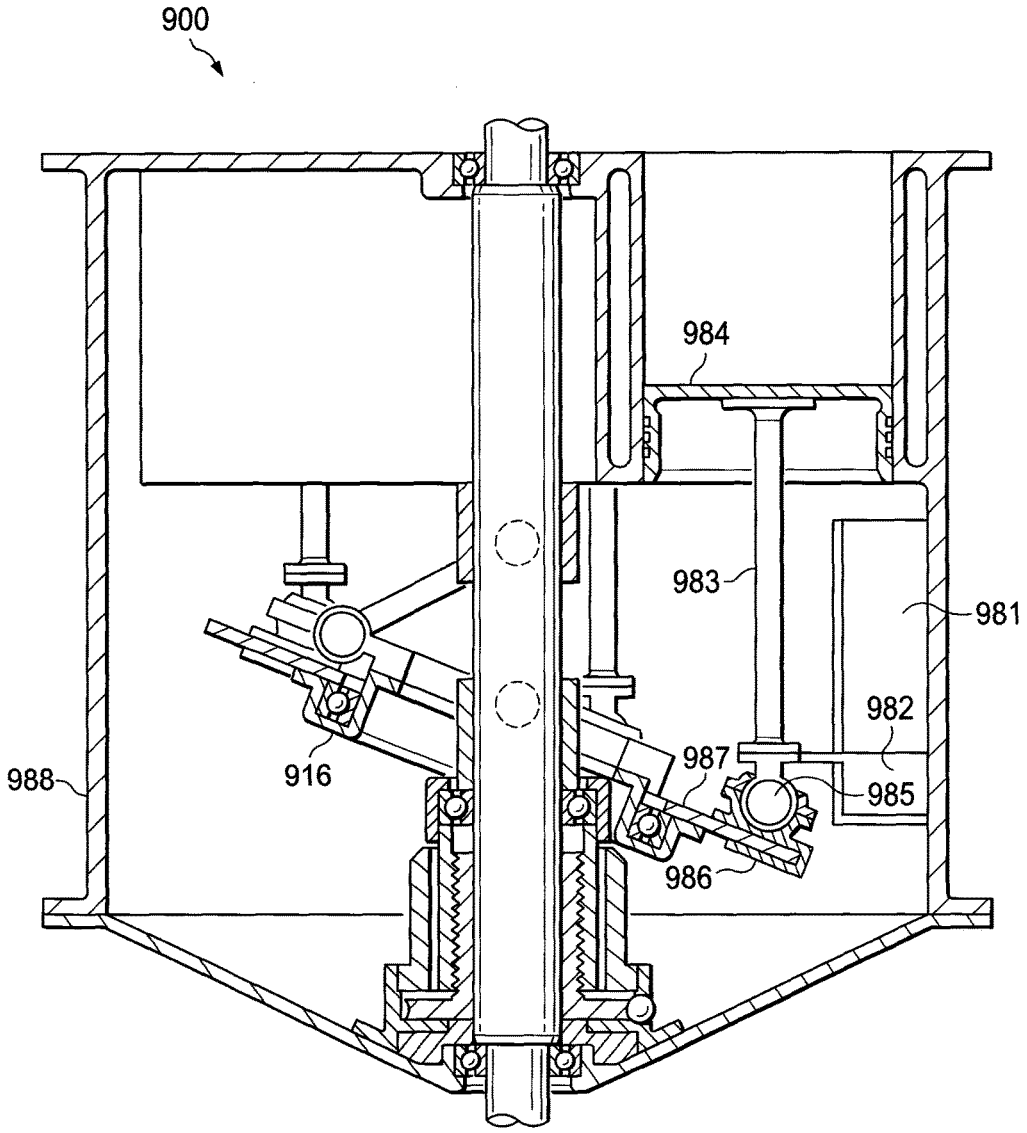
FIG. 9 is a cross-sectional side view of an engine block portion of an engine according to another embodiment ("fourth variation") illustrating aspects of an alternative connecting rod configuration.

Variable displacement engine 900 includes a rectangular vertical slot 981 and a slider mechanism 982 to restrict the lower end of a connecting rod 983 to motion parallel to the centerline of power shaft 108 as shown in FIG. 9 for piston 1. For this variation, the upper connecting rod bearing 132 (of FIG. 3) is no longer necessary and the connecting rod 983 is firmly attached to a piston 984. The only difference between the piston 984 and the piston 118 (of FIG. 3) is the method of joining the connecting rod to the piston. The lower end of connecting rod 983 is connected firmly to the upper surface of the arm of slider 982. The lower side of the arm of slider 982 is a spherical bearing 985. Bearing 985 connects slider 982 to a second slider mechanism 986. The changes described for piston one also apply to the remaining pistons.

The slider 986 is permitted to slide freely on a flat plate 987. The flat plate 987 takes the place of the second ring portion 142 of the wobble plate assembly 128 (piston control mechanism) shown in FIG. 3. In some embodiments, the plate 987 may be made a rotating part by eliminating the bearing 916, while in other embodiments bearing 916 is used to allow it to rotate freely. Allowing it to rotate freely will result in minimum friction due to natural processes. The rest of the piston control mechanism described in FIG. 3 remains unchanged, except that a ring gear 166 (FIG. 3) is not needed. Slot 981 can be made a part of cylinder block 988 or attached to it.

Variation 5—Use of a Universal Joint Mechanism in the Anti-Rotation Assembly and Displacement Actuator Referring now to FIGS. 10-12, there is illustrated an alternative variable displacement engine 1000 similar in many respects to the engine 100 described in connection with FIGS. 1-4. Only the elements that differ substantially from those describe in FIGS. 1-4 are renumbered. The variable displacement engine 1000 includes a universal joint ("U-joint") mechanism in the anti-rotation assembly rather than the ring gear 166 and mating outer lip "gear" portion 162 in FIG. 3, and also as part of the displacement actuator.

Figure 10:
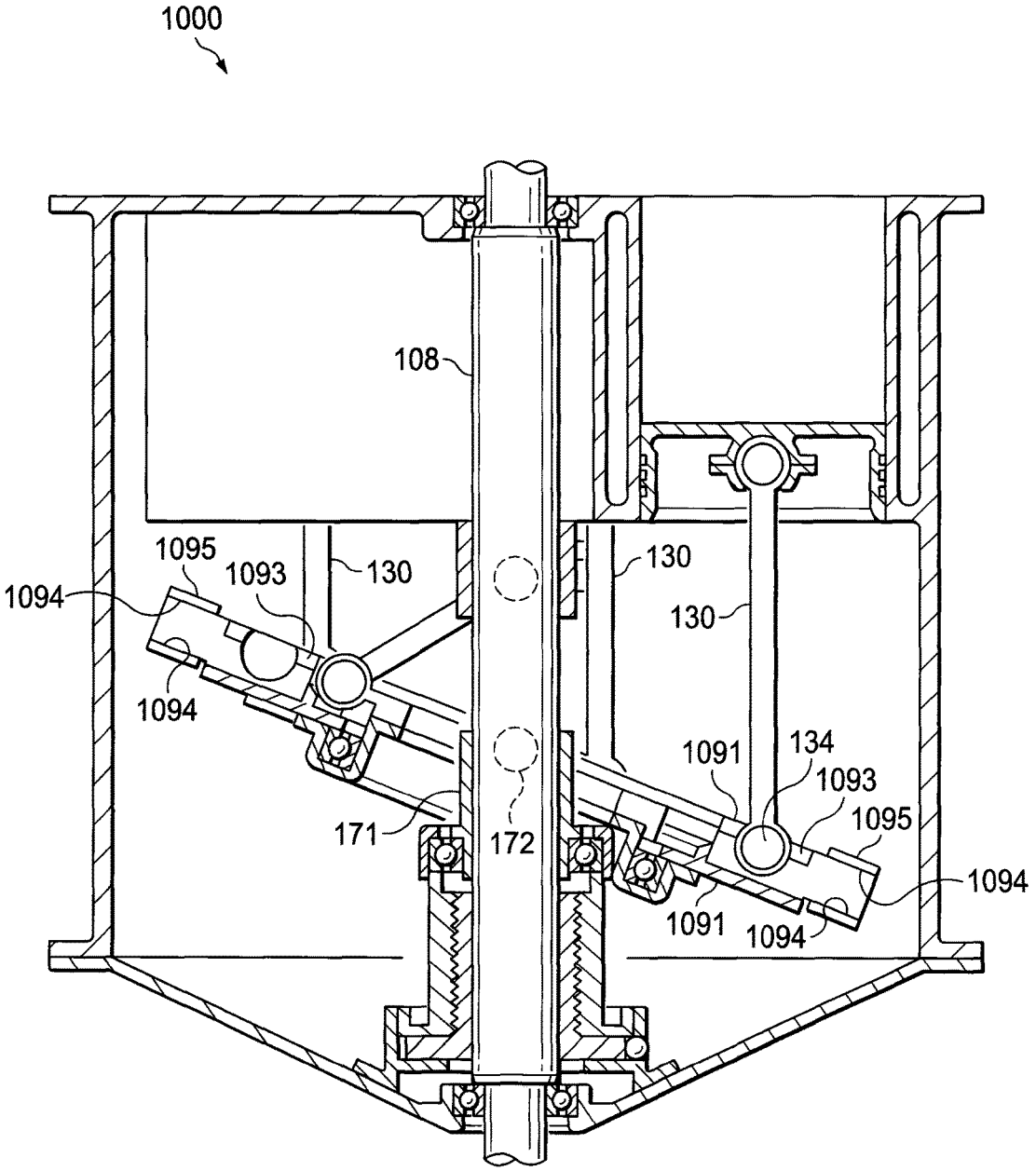
FIG. 10 is a cross-sectional side view, taken along line 10-10 of FIG. 11, of an engine block portion of an engine according to another embodiment ("fifth variation") illustrating aspects of a universal joint anti-rotation mechanism.
Figure 11:
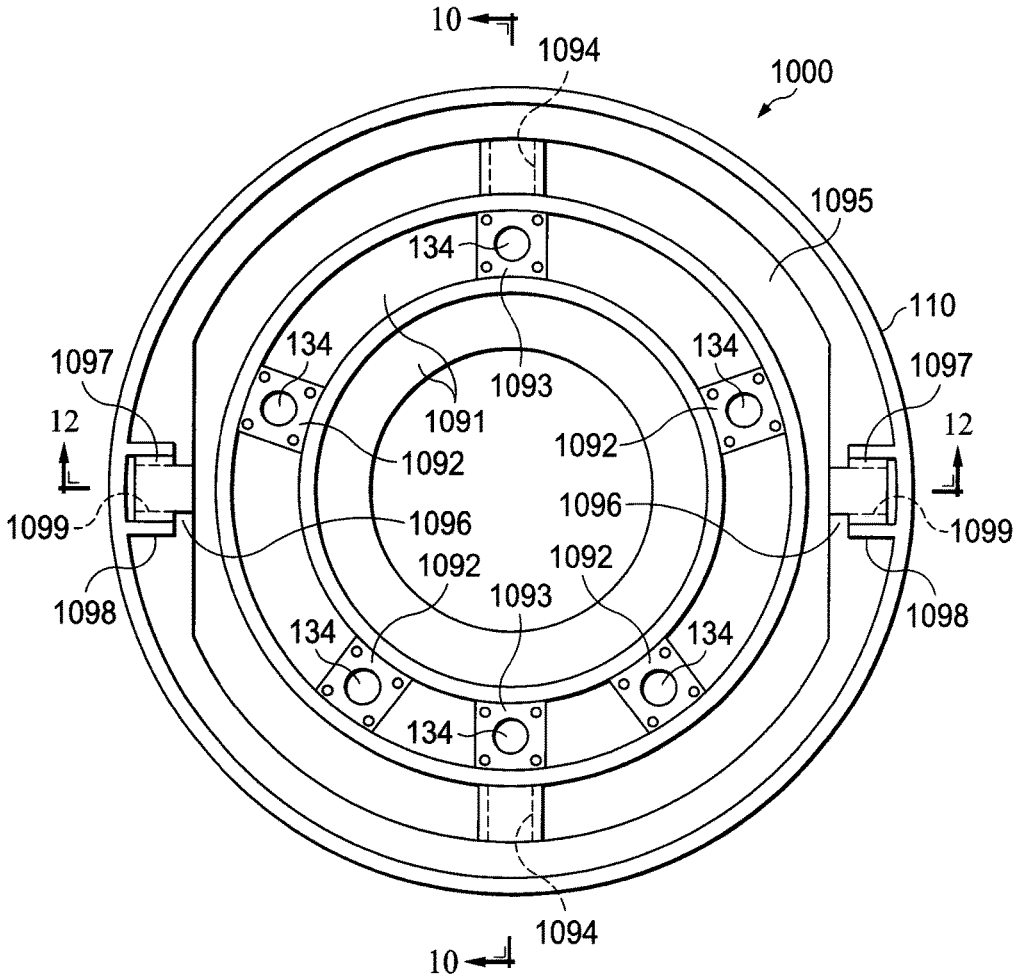
FIG. 11 is a partial top view of the engine of FIG. 10, further illustrating aspects of the anti-rotation mechanism.

Referring first to FIGS. 10 and 11, the wobble plate assembly 128 of FIG. 3 is modified to accommodate a U-joint mechanism comprising four connecting rod bearing blocks 1092 and two connecting rod bearing blocks 1093 (best seen in FIG. 11). The two parts 1093 are mounted opposite to each other on second ring portion 1091. The four bearing blocks 1092 and one bearing block 1093 are attached to the five connecting rods 130 by bearings 134.

Cylindrical extensions on the outer side of bearing blocks 1093 form the inner surface of bearings 1094 shown in FIGS. 10 and 11. The bearings 1094 connect the bearing blocks 1093 to a differential ring 1095 as shown in FIGS. 10 and 11. FIG. 11 shows a top view of part 1095.

Two cylindrical bearing extensions 1096 (FIG. 11) are located on the exterior side of the differential ring 1095. These extensions 1096 are each located 90 degrees from the two bearings 1094. Bearings 1099 attach the differential ring 1095 to a support structure 1097 as shown in FIGS. 11 and 12.

Figure 12:
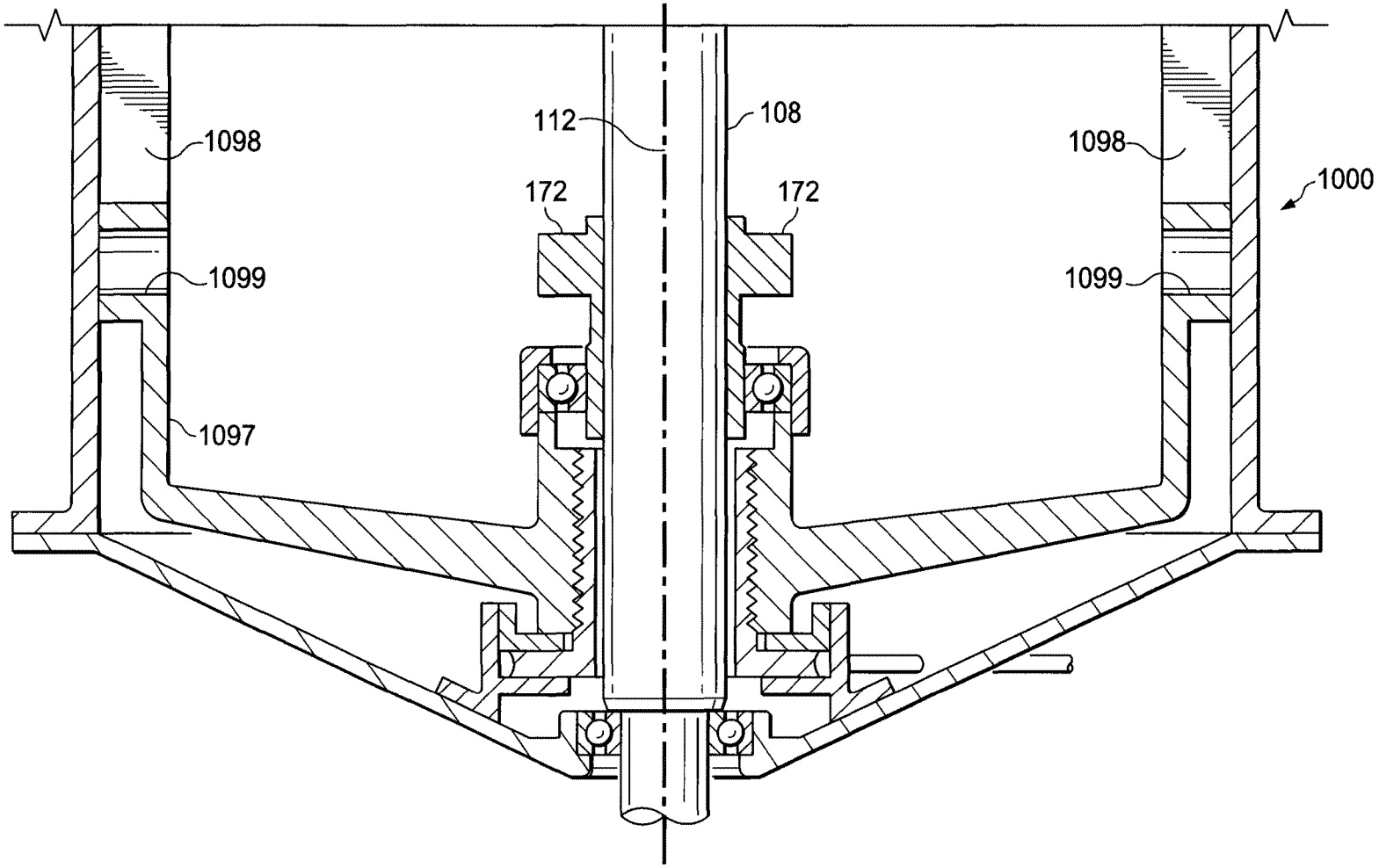
FIG. 12 is a partial cross-sectional side view of the engine of FIG. 10, taken along line 12-12 of FIG. 11, still further illustrating aspects of the anti-rotation mechanism.

Referring now to FIG. 12, the support structure 1097 is shown in detail. Note that the view of FIG. 12 is turned 90 degrees from that of FIG. 10. The structure 1097 is not visible in FIG. 10 since it is hidden from view by the power shaft 108. Note that the support structure 1097 moves along power shaft 108 in concert with the support collar 171 in FIG. 10. Support structure 1097 helps stabilize the U-joint ring 1094 and assure that the centerlines of the bearings 1099 and the pivot bearings 172 are always in the same plane normal to the centerline 112 of the power shaft 108. Guide slots 1098 in the cylinder block prevent rotation of the support structure 1097 and permit the arms of the support structure 1097 surrounding the bearings 1099 to move only in a direction parallel to the centerline 112 of the power shaft 108. Since the support structure 1097 is connected to the part 1091 as shown in FIG. 11, the part 1091 is also prevented from rotating.

The lift cylinder 198 and the housing 200 of the screw jack mechanism 186 in FIG. 3 are reconfigured as integral parts of the support structure 1097 in this embodiment as shown in FIG. 12. The rest of the screw jack mechanism 186 may be the same as shown in FIG. 3.

Variation 6—Use of a Constant Velocity Joint (CV-Joint) in the Anti-Rotation Assembly This variation (not shown) substitutes a constant velocity joint (similar to the concept used to power front-wheels in automobiles) for the U-joint of engine 1000. Details of the constant velocity joint mechanism are not shown.

Variation 7—Use of an Arm and a Track in the Piston Control Linkage

Figure 13:
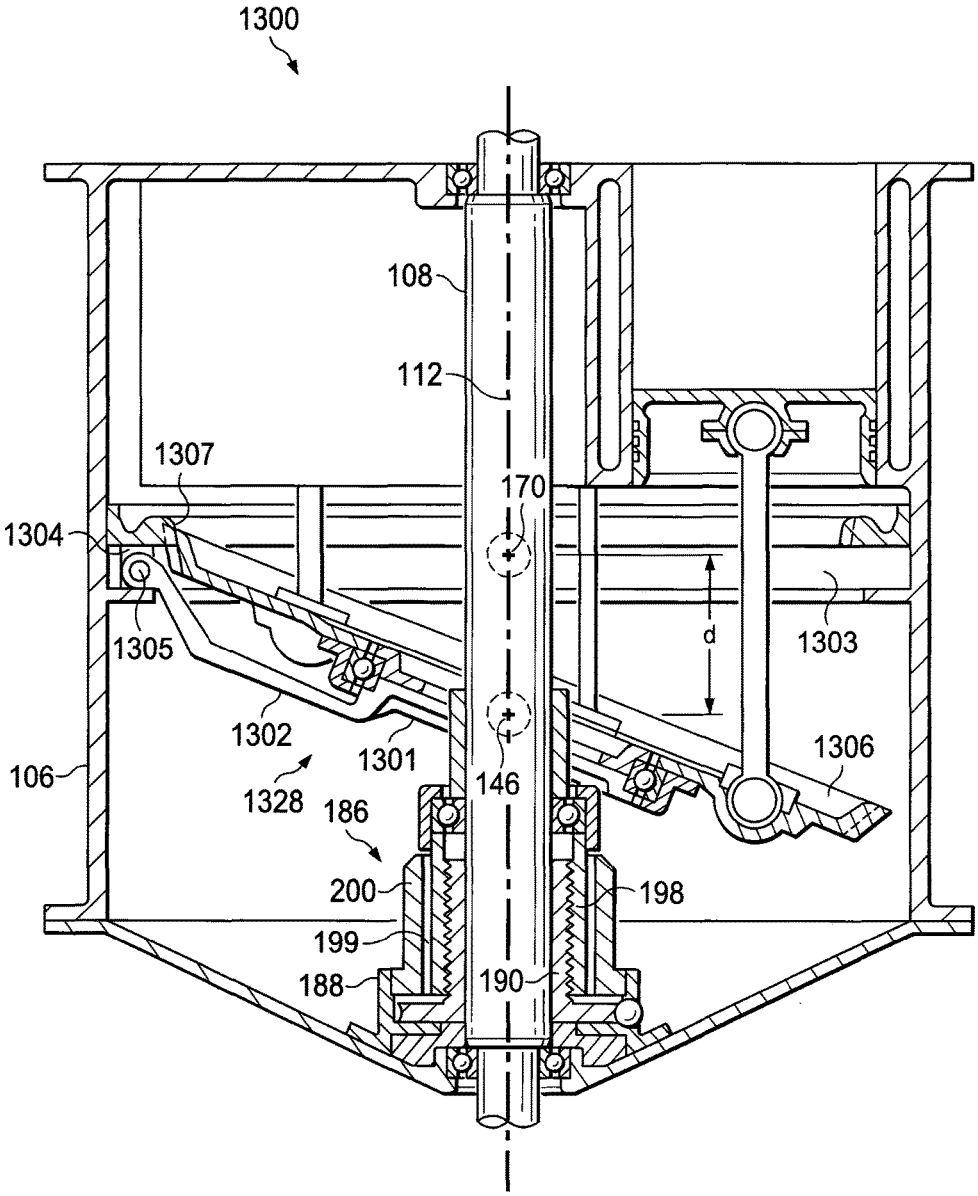
FIG. 13 is a cross-sectional side view of an engine block portion of an engine according to another embodiment ("seventh variation") illustrating aspects of an alternative piston control linkage.

Referring now to FIG. 13, there is illustrated an alternative variable displacement engine 1300 similar in many respects to the engine 100 described in connection with FIGS. 1-4. Only the elements that differ substantially from those describe in FIGS. 1-4 are renumbered.

Within the description of the variable displacement engine 100, it was shown that a specific extension of the second ring portion 142, specifically the teeth on the outer rim portion 162, always remained in a single plane perpendicular to the power shaft 108 (see also FIG. 5 and related description). This variable displacement engine 1300 takes advantage of that feature to provide an alternate design of the piston control mechanism.

The variable displacement engine 1300 comprises a wobble plate assembly 1328 that includes a first ring portion 1301 rather than the first ring portion 140 shown in FIG. 3. An extension (arm) 1302 extends from the ring portion 1301 to a circular track 1303 that is normal to the axis of power shaft 108 and adjacent to the inner wall of cylinder block 106. In the illustrated embodiment, the track 1303 is a slot. A follower assembly 1304 is attached the outer end of arm 1302 by a bearing 1305 and is configured to follow the path of the track 1303. In the illustrated embodiment, the follower assembly 1304 is a bearing block. As the power shaft 108 rotates, the bearing block 1304 traverses a circular path in the slot 1303. The length of arm 1302 is determined by the distance required to reach the plane normal to power shaft 108 that results in a constant compression ratio as the engine displacement is varied. This plane is shown in FIG. 5 as the line passing through points G-J-L. The centerline of the bearing 1305 always stays in this plane.

In the engine 1300 of the current embodiment, the control bearings 176, control link 178 and upper bearing 182 of engine 100 in FIG. 3 are no longer required. The upper collar 180, which is fixed to power shaft 108, is no longer required as a part of the piston control mechanism, but may be retained as a mechanical stop to limit minimum engine displacement. The second ring portion 142 in FIG. 3 is replaced by second ring portion 1306 to accommodate clearances for the arm 1302 and revised gear tooth profiles at its outer rim. A ring gear 1307 replaces the ring gear 166 in FIG. 3 to accommodate the revised gear tooth profiles. Other significant features of the engine design are unchanged from the engine 100.

In yet another embodiment (not shown) similar to that of engine 1300 in FIG. 13, a variable displacement engine 1400 comprises a circular track 1403 disposed on the engine block 106 to define an offset control plane that is oriented normal to the longitudinal axis 112 and intersects the longitudinal axis at an offset distance Y from the theoretical zero displacement point 170. A follower assembly 1404 including a follower operatively engages the track 1403 to constrain the motion of the follower to the offset control plane. An extension arm 1402 is operatively connected to a first ring portion 1401 of the wobble plate assembly so as to have a distal end positioned along a line parallel to, but longitudinally offset by the distance Y from, the wobble plate inclination plane. The extension arm 1402 is connected at the distal end to the follower assembly and causes the follower assembly to traverse the circular track as the power shaft 108 rotates. The extension arm 1402 is configured such that the distal end is positioned, when viewed in a direction parallel to the pivot axis 146, along the line parallel to, but longitudinally offset by a distance Y from, the wobble plate inclination plane.

Figure 14A:
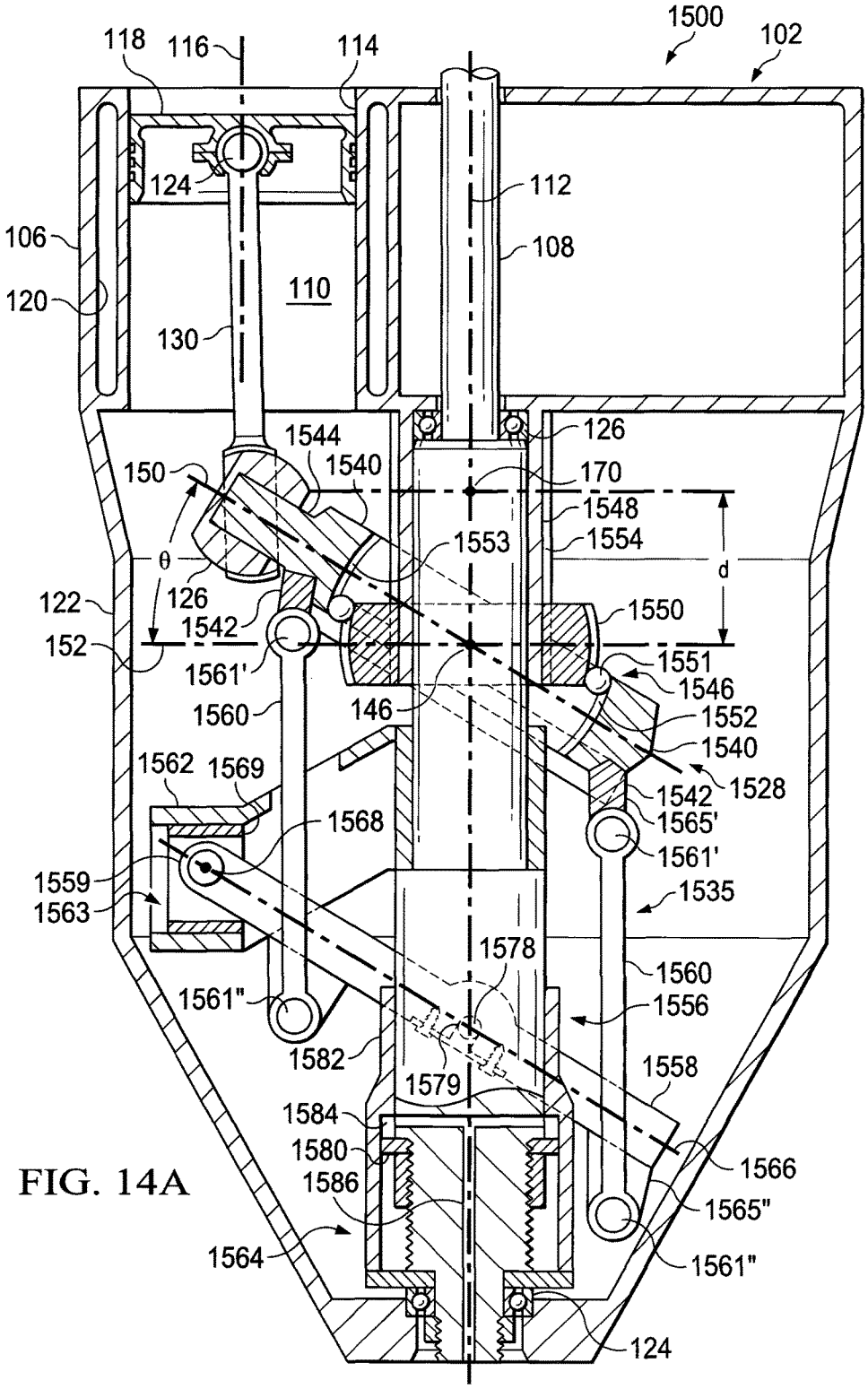
FIG. 14A is a partial cross-sectional side view of an engine block portion of a variable-displacement engine according to another embodiment ("eighth variation") illustrating aspects of an alternative engine and piston control mechanism.
Figure 14B:
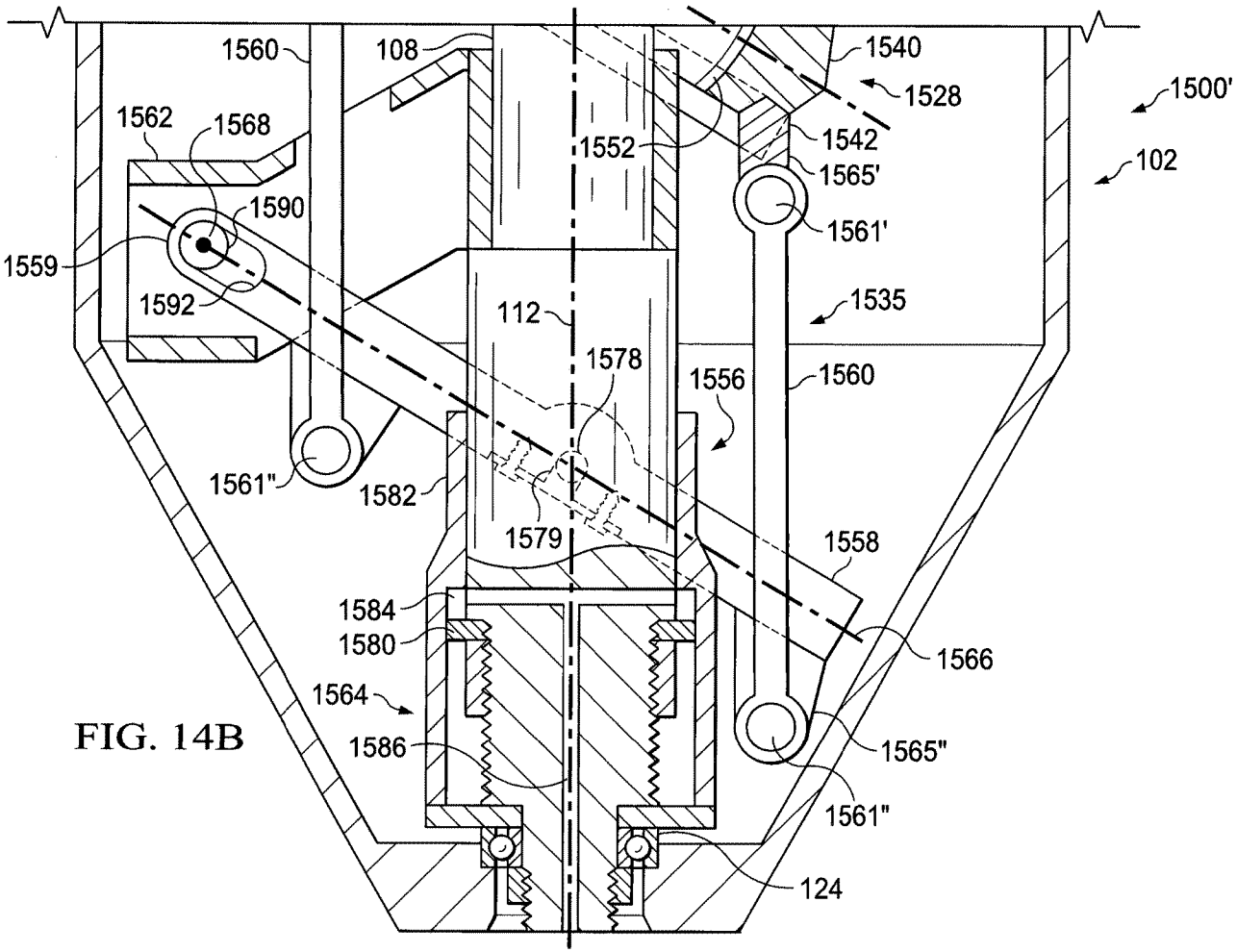
FIG. 14B is a partial view, similar to FIG. 14A, of a variable-displacement engine having an alternative piston control mechanism according to another embodiment.
Figure 15:
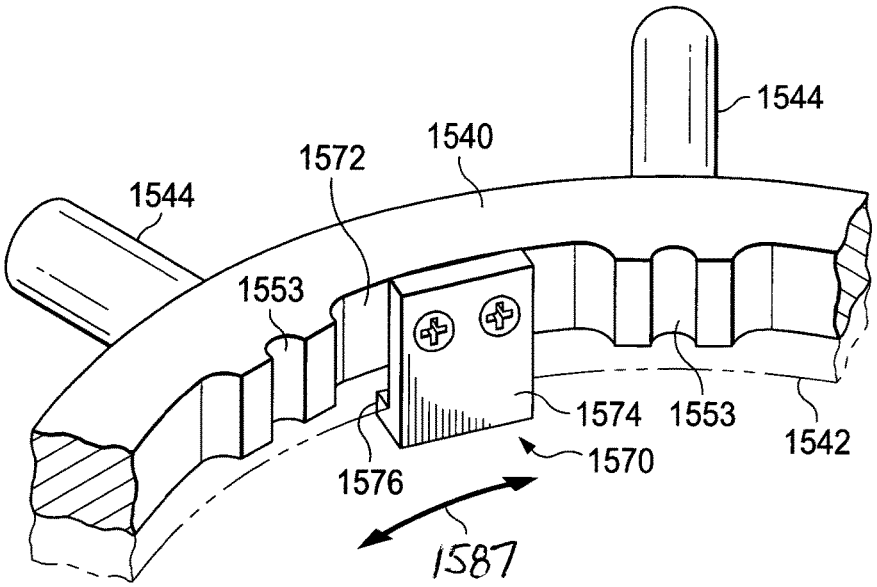
FIG. 15 is an enlarged perspective view, with portions broken away, of the wobble plate mechanism of FIG. 14A.

Variation 8—Use of a Vertically Fixed, Rotating Shoe in the Piston Control Mechanism (PCM) and Associated Linkage Referring now to FIGS. 14A, 14B and 15, there is illustrated an alternative variable-displacement engine 1500 in accordance with another aspect. The engine 1500 includes certain elements substantially similar to those previously described and illustrated herein; and such elements are denoted using the same reference numbers. Elements that differ substantially from those previously described are renumbered.

As with the embodiments previously described and illustrated herein, the variable-displacement engine 1500 utilizes a wobble plate mechanism 1528 to convert the reciprocating motion of pistons 118 traveling in cylinders 110 arranged coaxially around a central power shaft 108 (see FIG. 1) into rotary motion of the power shaft. Variable displacement is achieved by increasing or decreasing the stroke of the pistons 118 while simultaneously moving the center point 146 of the wobble plate 1528 to maintain a constant compression ratio. Piston stroke is determined by the wobble plate angle θ, and the compression ratio is determined by the distance d of the wobble plate center point 146 from the point at which the wobble plate angle would be zero, i.e., the theoretical zero displacement point 170. This relationship is expressed in mathematical terms by the equation $d=K \sin \theta$. K is a constant that is determined by the compression ratio and stroke of the pistons at any wobble plate angle θ. As previously described, the wobble plate center point 146 is the point at which the wobble plate line 150 (i.e., the line or plane passing through the centers of the lower connecting rod bearings 126) intersects the power shaft axis 112, and the wobble plate angle θ is the angle between the wobble plate line 150 and a plane 152 normal to the power shaft axis 112. It will be appreciated that determining the position of the theoretical zero displacement point 170 along the power shaft 108 or power shaft axis 112 does not require the wobble plate 1528 to actually move to a wobble plate angle θ=0 degrees; rather, the position of the theoretical zero displacement point 170 can be determined by simple extrapolation of the wobble plate movement allowed by the linkages of the piston control mechanism.

The variable-displacement engine 1500 of this embodiment includes a piston-control mechanism ("PCM") 1535 wherein pistons 118 and cylinder block 106 are rotationally fixed with relation to the engine mounting structure 102 such that the cylinder block does not rotate with the power shaft 108. The power generated by the linear motion of the pistons 118 is converted into output power produced by rotation of the power shaft 108. The piston control mechanism 1535 for this design is further described in the following paragraphs.

The wobble plate assembly 1528 includes a non-rotating upper ring portion 1540 that is rotatably slidably connected to a rotating lower ring portion 1542. This connection allows the lower ring portion 1542 to rotate (i.e., about the power shaft axis 112) independent of the upper ring portion 1540, but constrains the two portions to remain parallel to one another. Stated another way, a change in angle of one portion 1540, 1542 always causes an identical change in angle of the other portion. The pistons 118 are connected via connecting rods 130 to fixed locations on the non-rotating upper ring portion 1540 of the wobble plate 1528. For example, in the illustrated embodiment, the upper ring portion 1540 includes a plurality of mounting arms 1544 projecting radially outward and spaced apart from one another; the lower bearings 126 of the connecting rods 130 are mounted to these mounting arms. As mentioned earlier, the centers of the lower connecting rod bearings 126 lie in a plane 150 that passes through the center point 146 of the wobble plate 1528.

In the illustrated embodiment, the upper ring part 1540 of the wobble plate assembly 1528 is prevented from rotation by employing a constant-velocity joint 1546 (i.e., "CV joint"). The outer portion 1552 of the CV joint 1546 is connected to the upper ring portion 1540 of the wobble plate and the inner portion 1550 of the CV joint is connected to a tubular support 1548 affixed to, and extending from, the cylinder block 106. The tubular support 1548 surrounds the power shaft 108 and is concentric with it, but does not rotate.

As is known in conventional CV joints, the inner and outer portions 1550, 1552 of the CV joint 1546 are flexibly connected to one another with a plurality of CV balls 1551 disposed in races 1553 (see FIG. 15) formed on the opposing inward faces of the CV joint. Other components known in conventional CV joints may also be present in the CV joint 1546, but are not illustrated. The inner portion 1550 of the CV joint 1546 is permitted to slide axially (i.e., along the direction of shaft axis 112) along the tubular support 1548. The center point of the CV joint is common with the center point 146 of the wobble plate 1528. Rotation of the CV joint 1546 about the tubular support 1548 is prevented by splines 1554.

Although the CV joint 1546 in the illustrated embodiment is disposed radially within the annular space of the ring-shaped wobble plate 1528 (i.e., an "internal CV configuration"), in other embodiments the CV joint used to prevent rotation of upper ring portion 1540 may be disposed radially outside the wobble plate (i.e., an "external CV configuration"). In such external CV configuration, the inner portion of the CV joint may be connected to the upper ring portion 1540 and the outer portion of the CV joint may be secured to a non-rotating structure within the engine block 102 rather than to the tubular support 1548.

The rotating lower ring portion 1542 of the wobble plate 1528 is connected to the lower side of the non-rotating upper ring portion 1540 of the wobble plate (i.e., opposite to the side facing the pistons) by a bearing or bearing surface. This arrangement permits the forces on the pistons 118 generated by combustion of fuel and air to be transferred to the rotating part 1542 of the wobble plate and cause this part of the wobble plate to rotate. These forces can be very large, especially when the pistons 118 are near top-dead-center and the fuel/air mixture is ignited.

Referring now in particular to FIG. 15, there is illustrated one form of a connection that may be used to rotatably slidably connect the non-rotating upper ring portion 1540 of the wobble plate assembly 1528 to the rotating lower ring portion 1542. In the embodiment shown, a plurality of restraining straps 1570 are provided along the inner face 1572 of the upper ring portion 1540. Each retraining strap 1570 has a body portion 1574 that extends axially below the lower edge of the upper ring portion 1540 and a lip portion 1576 that extends radially outward a short distance. The lower ring portion 1542 (shown in broken line for purposes of illustration) is thereby captured on three sides: on the top face by the lower face of the upper ring portion 1540; on the inner face by the body portions 1574 of the restraining straps 1570; and on the lower face by the lip portions 1576 of the restraining straps. Accordingly, the lower ring portion 1542 can slide in a rotating direction (denoted by arrow 1587) relative to the upper ring portion 1540, but it is constrained to remain in contact with the upper ring portion as the angles of the ring portions change. In the illustrated embodiment, the restraining straps 1574 are connected with mechanical fasteners, however, in other embodiments the restraining straps could be connected by other means, e.g., welding, or formed as integral parts of the upper ring portion.

Referring again to FIG. 14A, after the piston forces are transmitted from the non-rotating upper ring portion 1540 to the rotating lower ring portion 1542, the forces in the lower ring portion are further transferred to a lever mechanism 1556 comprising another part of the PCM 1535. The lever mechanism 1556 also constrains the movement/position of the center point 146 of the wobble plate 1528 in accordance with the relationship $d=K \sin \theta$. Further still, the lever mechanism 1556 rotationally links the power shaft 108 to the rotating lower ring portion 1542 of the wobble plate 1528 so that the shaft and lower ring portion rotate together. The lever mechanism 1556 is vertically offset below the rotating part 1542 of the wobble plate at a distance sufficient to prevent interference between the lever mechanism and other parts of the PCM 1535.

The lever mechanism 1556 includes a lever beam 1558, mechanical links 1560 connecting the lever beam to the rotating lower ring portion 1542 of the wobble plate, an anchor support (shoe) 1562, and a lift mechanism 1564. The centerline 1566 of the lever beam 1558 may, but is not required to, be parallel to the centerline 150 of the wobble plate 1528 and duplicate the relationship $d=K \sin \theta$. The links 1560 transfer the forces from the rotating part 1542 of the wobble plate to the lever beam 1558 and cause the power shaft 108 to rotate with the rotating part of the wobble plate. Link bearings 1561 may be provided at each end of the links 1560 to allow pivotal connection to the wobble plate 1528 and the lever mechanism, respectively. One end (denoted 1559) of the lever beam 1558 may be pivotally connected to an anchor point 1568 that interfaces with the anchor support 1562 such that the anchor point 1568 can move rotationally with the power shaft 108 and radially (i.e., normal to the shaft axis 112) but cannot move axially (i.e., parallel to the shaft axis 112). In the illustrated embodiment, the anchor support 1562 has the form of a shoe defining a passageway 1563 oriented normal to the shaft axis 112, and the anchor point 1568 is mounted to a block 1569 that is slidably mounted in the passageway. The anchor support/shoe 1562 is attached to the power shaft 108 and rotates with it. Another interface of the lever beam 1558 with the power shaft 108 assures rotation of the lever beam with the power shaft.

In the illustrated embodiment, the links 1560 have an upper link bearing 1561' connected to the lower ring portion 1542 and a lower link bearing 1561" connected to the lever beam 1558. To allow room for the link bearings 1561', 1561" and avoid interference with other components, upper and lower mounting members 1565', 1565" may be provided projecting, respectively, axially below the lower ring portion 1542 and the lever beam 1558 by respective axial offset distances. In the illustrated embodiment, the axial offset distance of (the center of) the upper link bearing 1561' below the wobble plate line 150 is equal to the axial offset distance of (the center of) the lower link bearing 1561" below the beam lever centerline 1566 on the same link. In other words, the axial offset distances for the upper and lower link bearings 1561', 1561" are equal on each individual link; however, the upper axial offset distances on different links may be different from one another and/or the lower axial offset distances on different links may be different from one another. In other embodiments, the axial offset distances may be equal for all links.

Axial forces from the pistons 118 and torque forces from the wobble plate 1528 are divided by the lever beam 1558 primarily between the anchor support/shoe 1562 and the lift mechanism 1564. The lift mechanism 1564 is axially slidably mounted on the power shaft 108 and pivotally connected to an intermediate point on the lever beam 1558. In the illustrated embodiment, the lift mechanism 1564 is connected at a lift pivot 1578 disposed at the intersection of the lever beam centerline 1566 and the power shaft axis 112. During operation, a lift collar 1582 of the lift mechanism 1564 slides axially along the power shaft. The lever beam 1558 is pivotally supported by a pair of lift bearings 1579 (shown in broken line) connected to each side of the lift collar 1582 along a line running through the pivot point 1578 and normal to the shaft axis 112. Thus, raising and lowering the lift collar 1582 moves the pivot point 1578 for the lever beam 1558 axially along the shaft axis 112, thereby changing the angle of the lever beam 1558 relative to the shaft axis (since the outer end 1559 of the lever beam is axially constrained by anchor points 1568). Changing the angle of the lever beam 1558 in turn changes (via the interconnected links 1560) the angle of the wobble plate 1528 to set the piston stroke (hence engine displacement) and to change the position of the wobble plate center point 146 to maintain the relationship $d=K \sin \theta$. In the illustrated embodiment, the lift mechanism 1564 includes a lift ring 1580 fixedly mounted to the power shaft 108 and a lift collar 1582 slidingly mounted over both the lift ring and the power shaft to form a hydraulic cavity 1584. Passages 1586 formed in the power shaft 108 may allow hydraulic fluid (from an external source) to flow into and out of the cavity 1584 to form a hydraulic cylinder that can raise and lower the collar 1582 along with the pivot point 1578 mounted on the collar.

In other embodiments, the lift mechanism 1564 may include a collar 1582 mounted around the power shaft 108, a bearing set 1579 that maintains the location of the lever center point 1578 along the centerline 112 of the power shaft 108, and a hydraulic cylinder 1584 surrounding the power shaft. The collar 1582 is permitted to slide axially along the power shaft 108. One end of the hydraulic cylinder can be a part of the power shaft so that the forces of the lift are transferred from the lever to the power shaft. The lift mechanism 1564 may be powered by an external source of high pressure hydraulic fluid to control engine displacement.

The axial forces produced by the pistons 118 and radial torque forces produced by the PCM 1535 are transferred to the engine block 102 by bearings 124, 126 on the power shaft 108 and/or the shoe 1562.

Referring now to FIG. 14B, in alternative embodiments of the engine (denoted 1500'), the axial anchor point 1568 for the lever beam 1558 may be fixed both axially (i.e., in a direction parallel to the shaft axis 112) and radially (i.e., in a direction normal to the shaft axis) with respect to the power shaft 108, although still rotating with the power shaft, rather than being slidably movable in the radial direction. In the illustrated embodiment of FIG. 14B, the anchor point 1568 is the center of a pin or bearing 1590 fixedly mounted in anchor support 1562. In such embodiments, the slider block 1569 is not required, and the upper end 1559 of the lever beam 1558 may be provided with a slot 1592 that slidingly engages over the bearing 1590 of the anchor point 1568. As the lift mechanism 1564 moves the lever beam pivot point 1578 axially along the shaft axis 112 to vary the angle of the lever beam 1558 (and hence, the angle $\theta$ of the wobble plate 1528) with respect to the shaft axis 112, the slot 1592 in the end 1559 of the lever beam can move along the bearing 1590 to accommodate the change in distance between the pivot point 1578 and the anchor point 1568. In different embodiments, the slot 1592 may have a straight or curved path, and may run parallel to the centerline 1566 or be angled with respect to the centerline so as to adjust the relationship between movement of the PCM and wobble plate angle.

Small variations in the design of the PCM 1535 in this embodiment can be readily made to permit optimization of engine performance. Some of the factors that might be considered are angle of connecting rods with respect to power shaft centerline, slight variations in compression ratio to reduce emissions, and lowering compression ratio near minimum displacement to reduce starter loads and engine roughness at idle.

Figure 16:
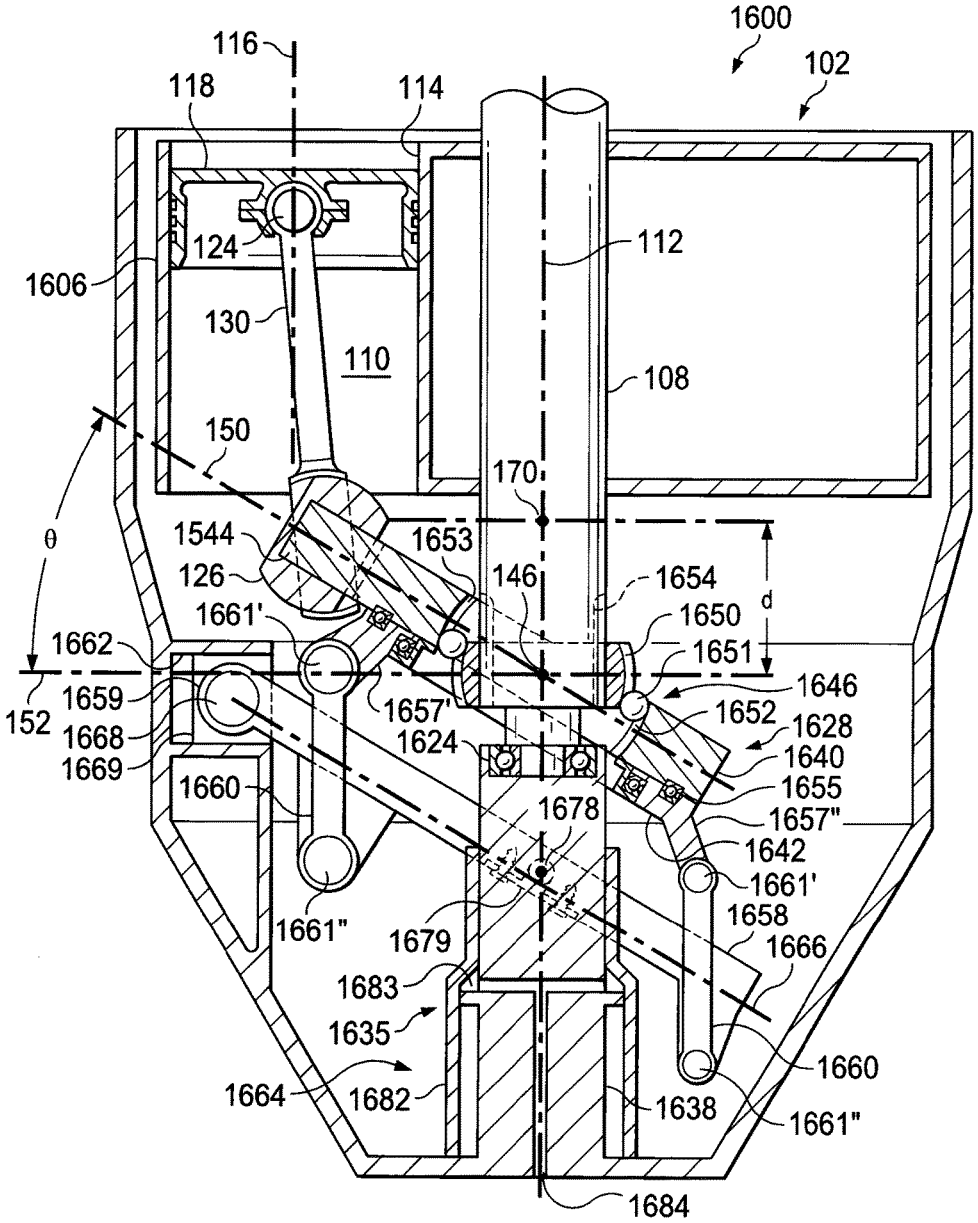
FIG. 16 is a partial cross-sectional side view of an engine block portion of another variable-displacement engine according to another embodiment ("ninth variation") illustrating aspects of another alternative engine and piston control mechanism.

Variation 9—Use of a Rotating Cylinder Block Rotating with the Power Shaft, and Non-Rotating Piston Control Mechanism (PCM) and Associated Linkage Referring now to FIG. 16, there is illustrated an alternative variable-displacement engine 1600 in accordance with another aspect. The engine 1600 includes certain elements substantially similar to those previously described and illustrated herein; and such elements are denoted using the same reference numbers. Elements that differ substantially from those previously described are renumbered.

In contrast to previous embodiments wherein the cylinder block 106 is rigidly connected to the engine block 102, the engine 1600 of this embodiment is a continuously variable displacement engine wherein the cylinders 110 are formed in a separate cylinder block 1606 that can rotate relative to the engine block 102 and external engine structure. In the illustrated embodiment of engine 1600, the cylinder block 1606 is connected to the power shaft 108 and rotates with the power shaft within the external engine structure 102. Accordingly, in this embodiment, the pistons 118 reciprocating (in the axial direction) within the cylinders 110 of the cylinder block 1606 also revolve (in a circumferential direction) around the axis 112 of the power shaft 108 as the cylinder block rotates with the power shaft. The piston control mechanism 1635 for the engine 1600 is similar in many respects to the PCM 1535 used in engine 1500 (i.e., the seventh variation); however, it is modified (as described herein) to operate with the rotating cylinder block 1606 and revolving pistons 118.

In particular, referring still to FIG. 16, one or more cylinders 110 may be located within the cylinder block 1606 and arranged around the central power shaft 108 that rotates with the cylinder block. The centerlines 116 of the cylinders 110 are nominally parallel to the centerline 112 of the power shaft 108. A wobble plate mechanism 1628 is used to convert power from the pistons 118 to rotate the central power shaft 108.

In the engine 1600, variable displacement is achieved by increasing or decreasing the stroke of the pistons 118 while concurrently moving the center point 146 of the wobble plate 1628 so as to maintain a constant compression ratio. Piston stroke is determined by the wobble plate angle $\theta$, and the compression ratio is determined by the distance, d, of the wobble plate center point 146 from the theoretical zero displacement point 170, i.e., the location at which the wobble plate angle $\theta$ would be zero degrees. This relationship is expressed in mathematical terms by the equation $d=K \sin \theta$, where K is a constant that is determined by the compression ratio and stroke of the piston at any wobble plate angle $\theta$. It will be appreciated that piston control mechanisms moving according to the $d=K \sin \theta$ relationship may be used to provide variable displacement and constant compression ratio regardless of whether the cylinders 110 of the engine are fixed with respect to the engine block structure 102 or rotating/revolving with respect to the engine block structure.

In the engine 1600, the power generated by the linear motion of the pistons 118 is converted into output power produced by rotation of the power shaft 108. The rotating cylinder block 1606 is held to a constant axial position by bearings 1624. The piston control mechanism ("PCM") 1635 for the engine 1600 includes a wobble plate assembly 1628 including a rotating upper ring portion 1640 and a non-rotating lower ring portion 1642. It will be appreciated that the relative positions of the rotating and non-rotating portions of the wobble plate 1628 of engine 1600 are inverted from the arrangement of the rotating and non-rotating portions of the wobble plate 1528 of engine 1500.

In the engine 1600, each piston 118 is connected to a relatively fixed location on the rotating upper portion 1640 of the wobble plate 1628 by a connecting rod 130 (in this case, the term "relative fixed" is used because the pistons 118 and the upper portion 1640 of the wobble plate both rotate together with the power shaft 108, and thus do not rotate relative to one another). The connecting rod 130 transfers the axial forces from the piston 118 to the rotating upper portion 1640 of the wobble plate. The center of the lower connecting rod bearing 126 lies in a plane 150 that passes through the center point 146 of the wobble plate 1628. The upper rotating part 1640 of the wobble plate 1628 is constrained by a constant-velocity ("CV") joint 1646 to rotate with the cylinder block 1606. The CV joint 1646 has an inner portion 1650 connecting to the power shaft 108. The outer portion 1652 of the CV joint 1646 is fixed to the upper portion 1640 of the wobble plate. The inner portion 1650 of the CV joint is permitted to slide axially along the power shaft 108 but is constrained to rotate with the power shaft by splines 1654. The center point of the CV joint 1646 is held common with the center point 146 of the wobble plate 1628 by the CV balls 1651 linking the two portions 1650, 1652 of the CV joint.

Although the CV joint 1646 in the illustrated embodiment is disposed radially within the annular space of the ring-shaped wobble plate 1628 (i.e., an "internal CV configuration"), in other embodiments the CV joint used to ensure rotation of upper ring portion 1640 with the power shaft 108 may be disposed radially outside the wobble plate (i.e., an "external CV configuration"). In such external CV configuration, the inner portion of the CV joint may be connected to the upper ring portion 1640 and the outer portion of the CV joint may be secured to a rotating portion of the cylinder block 1606 rather than to the power shaft itself.

The PCM 1635 of the engine 1600 further includes the lower, non-rotating portion 1642 of the wobble plate 1628. In the illustrated embodiment, the lower portion 1642 has a ring-like configuration (disposed around the power shaft 108) and is connected to the lower side of the upper, rotating portion 1640 of the wobble plate (opposite from the side facing the pistons) by bearings 1655. The non-rotating part 1642 of the wobble plate controls the wobble plate angle θ. The non-rotating part 1642 includes a first extension 1657' attached to the (axially) uppermost portion of the non-rotating part and a second extension 1657" attached to the (axially) lowest portion of the part. These extensions 1657', 1657" allow the lower, non-rotating part 1642 of the wobble plate 1628 to be connected to a control lever 1658 through bearings 1661' and 1661" located at each end of control links 1660. One end 1659 of the control lever 1658 is connected to a slider block 1669 by a bearing 1668. The slider block 1669 is constrained by a slot 1662 that permits the block to slide a short distance along a radial line extending perpendicularly from the axis 112 of the power shaft 108 (or an extension thereof). The slot 1662 forces the bearing 1668 to become an anchor point at the high end 1669 of the control lever 1658 that constrains this end of the control lever to a single axial position. The slot 1662 may also prevent the control lever 1658 from rotating with the power shaft 108, and supports a major part of the axial forces produced by the pistons 118. The control lever 1658 and the two links 1660 prevent rotation of the lower non-rotating portion 1642 of the wobble plate. The slot 1662 is located a sufficient distance from the wobble plate 1628 to avoid any physical interference with the wobble plate.

In other embodiments (not shown), the bearing 1668 for the control lever 1658 may be fixed both axially (i.e., in a direction parallel to the shaft axis 112) and radially (i.e., in a direction normal to the shaft axis) with respect to the power shaft 108, rather than being slidably movable in the radial direction. In such embodiments, the slider block 1669 is not required, and the upper end 1659 of the control lever 1658 may be provided with a slot (similar to slot 1592 in FIG. 14B) that slidingly engages over the bearing 1668. As the lift mechanism 1664 moves the control lever pivot point 1678 axially along the shaft axis 112 to vary the angle of the control lever 1658 (and hence, the angle θ of the wobble plate 1628) with respect to the shaft axis 112, the slot in the end 1659 of the control lever can move along the bearing 1668 to accommodate the change in distance between the pivot point 1678 and the anchor point bearing 1668. In different embodiments, the slot may have a straight or curved path, and may run parallel to the centerline 1666 or be angled with respect to the centerline so as to adjust the relationship between movement of the PCM and wobble plate angle.

Referring still to FIG. 16, a centerline 1666 through the length of the control lever 1658 may be, but is not necessarily, parallel to the centerline 150 of the wobble plate 1628. The control lever 1658 and the two links 1660 to the non-rotating portion 1642 of the wobble plate control the wobble plate angle θ. They also control the movement of the center point of the wobble plate along the power shaft to maintain the $d=K \sin \theta$ relationship discussed earlier as necessary for a constant compression ratio.

A support member 1638 whose centerline lies along the extension of the power shaft centerline 112 may be provided to support the bearing 1624 of the power shaft 108. A lift collar 1682 around the support 1638 constrains a pivot point 1678 on the centerline 1666 of the control lever 1658 to move axially along the centerline 112 of the power shaft 108 as the angle of the control lever (and hence, also the wobble plate angle θ) is changed to vary engine displacement. This feature is provided by the use of two bearing posts 1679 attached to the lift collar 1682 so that their centerline passes through the pivot point 1678 and the power shaft centerline 112 (or extension). These posts 1679 support bearings located along the centerline 1666 of the control lever 1658.

The displacement of engine 1600 is varied by axially moving the lift collar 1682 of the lift mechanism 1664 along the central support member 1638. The lever beam 1658 is pivotally supported by a pair of lift bearings 1679 (shown in broken line) connected to each side of the lift collar 1682 along a line running through the pivot point 1678 and normal to the shaft axis 112. Thus, raising and lowering the lift collar 1682 moves the pivot point 1678 for the lever beam 1658 axially along the shaft axis 112. Since the upper end 1669 of the control lever 1658 is always at a fixed axial position due to the slot 1662, axially moving the middle portion of the control lever by lifting the collar 1682 and bearing posts 1679 will change the angle of the control lever with respect to the power shaft axis 112, which in turn similarly changes the wobble plate angle θ by means of the links 1660. The force necessary to axially move the collar 1682 may be provided by a lift including such devices as a mechanical jack or a hydraulic piston. One configuration to provide the necessary force is to attach a hydraulic piston to the collar 1682. In the illustrated embodiment, a hydraulic piston surrounds the bearing support 1638 and is powered by high pressure hydraulic fluid (e.g., engine oil) introduced into a hydraulic piston space 1683 through passages 1684 formed in the support, thereby axially moving the lift collar 1682.

Figure 17:
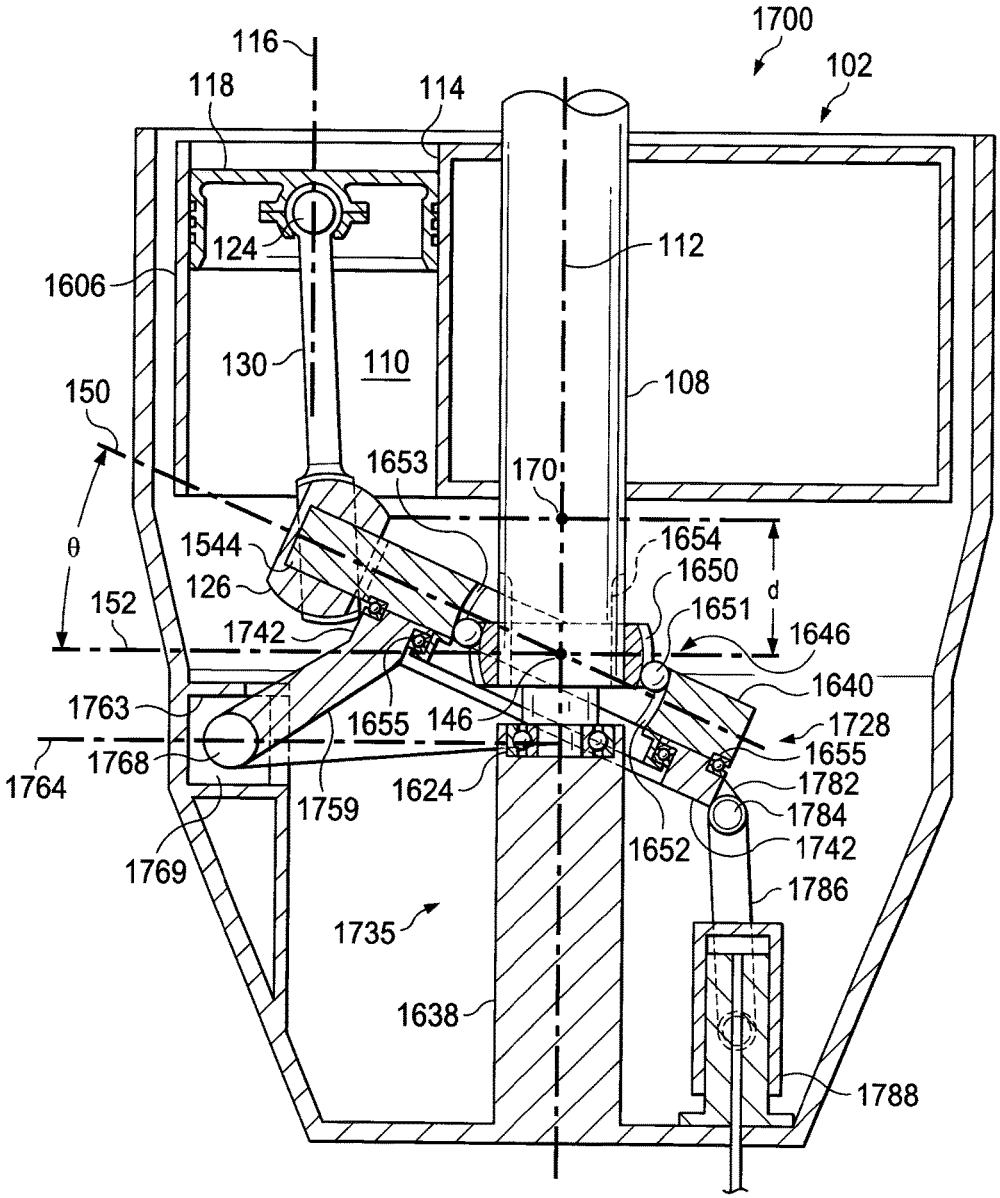
FIG. 17 is a partial cross-sectional side view of an engine block portion of still another variable-displacement engine according to another embodiment ("tenth variation") illustrating aspects of another alternative engine and piston control mechanism.

Variation 10—Use of a Rotating Cylinder Block Rotating with the Power Shaft, and Alternative Non-Rotating Piston Control Mechanism (PCM) and Associated Linkage Referring now to FIG. 17, there is illustrated an alternative variable-displacement engine 1700 in accordance with still another aspect. The engine 1700 includes certain elements substantially similar to those previously described and illustrated herein; and such elements are denoted using the same reference numbers. Elements that differ substantially from those previously described are renumbered The engine 1700 of this embodiment is a continuously variable displacement engine wherein a separate cylinder block rotates within the external engine structure similar to the engine 1600 ("ninth variation") previously described; however, the engine 1700 includes a simplified piston control mechanism ("PCM").

In engine 1700, one or more cylinders 110 are located within a cylinder block 1606 and are arranged around a central power shaft 108 that rotates with the cylinder block 1606. The centerlines 116 of the cylinders 110 are nominally parallel to the centerline 112 of the power shaft 108. The power shaft 108 is attached firmly to the cylinder block 1606 and does not move axially within the engine block structure 102. A wobble plate mechanism 1728 is used to convert power from the pistons 118 to rotate the central power shaft 108. It will be understood in the following description that the singular term "piston" is meant to apply to all pistons in an engine having multiple pistons.

Similar to previously described embodiments, variable displacement is achieved in engine 1700 by increasing or decreasing the stroke of the piston 118 while concurrently moving the center point 146 of the wobble plate 1728 so as to maintain essentially a constant compression ratio. Piston stroke is determined by the wobble plate angle θ (measured along the wobble plate centerline 150 relative to a plane 152 normal to the power shaft axis 112), and the compression ratio is determined by the distance (denoted d) of the wobble plate center point 146 from the theoretical zero displacement point 170, i.e., the point at which the wobble plate angle would be zero. The desired relationship is expressed in mathematical terms by the equation $d=K \sin \theta$. K is a constant that is determined by the compression ratio and stroke of the piston at any wobble plate angle θ. In some embodiments of engine 1700, the wobble plate movement produced by the piston control mechanism 1735 does not perfectly match the $d=K \sin \theta$ relationship, but the error can be made small enough that the resulting variation in compression ratio is acceptable for many applications of the variable displacement engine.

The design of a cylinder head (not shown) for mounting on the rotating cylinder block 1606 and the associated supporting structure may be varied in different embodiments to meet the specific requirements of each engine. The illustrated embodiment of engine 1700 features elements that may be required in any design of an engine with a rotating cylinder assembly. Specifically, the end of the power shaft 108 near the wobble plate 1728 is held in place by a bearing 1724 between the power shaft and a support 1738 attached to the exterior frame (e.g., engine block 102) of the engine. The centerline of the support 1738 lies along an extension of the centerline axis 112 of the power shaft 108. The support 1738 may be solid (as illustrated) or hollow, and may permit an extension of the power shaft 108 to pass through to connect to external engine components.

As in previous embodiments, the power generated by the reciprocating linear motion of the piston 118 in the engine 1700 is converted into output power by a wobble plate 1728 that produces rotation of the power shaft 108. The simplified piston control mechanism (PCM) 1735 for this embodiment is further described below.

Each piston 118 is connected to a (relatively) fixed location on the upper rotating portion 1640 of the wobble plate 1728 by a connecting rod 130. The connecting rod 130 transfers the forces from the piston 118 to the rotating wobble plate 1728. The center of the connecting rod lower bearing 126 (at opposite end from the piston) lies in a plane 150 that passes through the center point 146 of the wobble plate 1728. The upper rotating part 1640 of the wobble plate is constrained by a constant-velocity (CV) joint to rotate with the cylinder block 1606. The CV joint 1646 has an inner portion 1650 connected to the power shaft 108. An outer portion 1652 of the CV joint 1646 is fixed to the upper portion 1640 of the wobble plate. The inner portion 1650 of the CV joint is permitted to slide axially along the power shaft 108 but is constrained to rotate with the power shaft by splines 1654. The center point of the CV joint 1646 is held common with the center point 146 of the wobble plate by the CV ball bearings 1651 linking races 1653 on the two portions of the CV joint.

Although the CV joint 1646 in the illustrated embodiment is disposed radially within the annular space of the ring-shaped wobble plate 1728 (i.e., an "internal CV configuration"), in other embodiments the CV joint used to ensure rotation of upper ring portion 1640 with the power shaft 108 may be disposed radially outside the wobble plate (i.e., an "external CV configuration"). In such external CV configuration, the inner portion of the CV joint may be connected to the upper ring portion 1640 and the outer portion of the CV joint may be secured to a rotating portion of the cylinder block 1606 rather than to the power shaft itself.

A lower, ring-like non-rotating part 1742 of the wobble plate 1728 is connected to the lower side of the rotating part 1640 (opposite from the side facing the pistons) by bearings 1655. The non-rotating part 1742 of the wobble plate 1728 controls the wobble plate angle θ and the movement of the center point 146 of the wobble plate to vary the displacement of engine 1700.

The PCM 1735 of this embodiment includes an axial anchor arm 1759 extending from the non-rotating part 1742 of the wobble plate 1728. In the illustrated embodiment, the axial anchor arm 1759 extends from the (axially) uppermost position of the non-rotating portion 1742. A bearing 1768 at the outer end of the anchor arm 1759 pivotally connects the anchor arm to a slider block 1769. The slider block 1769 is permitted to slide in a slot/path 1763 nominally along a line 1764 normal to the centerline 112 of the power shaft. In the illustrated embodiment, the slider block 1769 is constrained by slot 1763 that is rigidly attached to the engine structure 102. The slot 1763 is configured to maintain the effective outer end 1768 of the anchor arm 1759 at a nominally constant axial position. However, in some embodiments, the shape of the slot 1763 may be tailored to meet the requirement for essentially constant compression ratio as the displacement is varied. For example, the slot 1763 may be nominally at a constant axial position but may be slightly sloped and/or curved to meet the compression ratio needs of the engine. The slot 1763 also prevents the lower, non-rotating part 1742 of the wobble plate from rotating. The slider block 1769 may slide a short distance from an outermost position at maximum wobble plate angle ($\theta_{max}$) to an innermost position at minimum wobble plate angle ($\theta_{min}$). The specific location of the bearing 1768 is normally selected as the location that results in the least variation in compression ratio, but may vary for optimization of the engine design.

The PCM 1735 of the engine 1700 may further include a lift arm 1782 extending from another part of the non-rotating portion 1742 of the wobble plate. Typically, the lift arm 1782 is attached on the opposite side of the non-rotating portion 1742 from the anchor arm 1759. In the illustrated embodiment, the lift arm 1782 extends from the (axially) lowest location of the lower portion 1742, opposite from the anchor arm 1759. The outer end 1784 of the lift arm 1782 is connected through bearings and a link 1786 to a lift mechanism 1788. As the lift mechanism 1788 raises and lowers the lift arm 1782 in the axial direction, the wobble plate angle θ changes (and hence, the engine displacement changes) since the other side of the non-rotating portion 1742 is axially pinned by bearing anchor point 1768 at the outer end of the anchor arm 1759 riding in the slot 1763.

The lift 1788 may be constructed of such devices as a mechanical jack or a hydraulic piston. The hydraulic piston could be powered by high pressure hydraulic fluid such as engine oil. The mechanical jack could be powered by external means.

In other embodiments (not shown), the bearing 1768 for the anchor arm 1759 may be fixed both axially (i.e., in a direction parallel to the shaft axis 112) and radially (i.e., in a direction normal to the shaft axis) with respect to the power shaft 108, rather than being slidably movable in the radial direction. In such embodiments, the slider block 1769 is not required, and the end of the anchor arm 1759 may be provided with a slot (similar to slot 1592 in FIG. 14B) that slidingly engages over the bearing 1768. As the lift mechanism 1788 moves the wobble plate center 146 along the shaft axis 112 to vary the angle θ, the slot in the end of the anchor arm 1759 can move along the bearing 1768 to accommodate the change in distance between the wobble plate center 146 and the anchor arm bearing 1768. In different embodiments, the slot may have a straight or curved path, and may run parallel to the centerline of the anchor arm or be angled with respect to the centerline so as to adjust the relationship between movement of the PCM and wobble plate angle.

Referring once again to FIG. 14A, and also to FIGS. 18-24, it will be appreciated that when considering additional aspects of new variable displacement engines and controls therefor, compression ratio is an important parameter in achieving the desired engine characteristics. This parameter (i.e., compression ratio) is especially important in the design of a continuously variable displacement engine because of the challenges involved in keeping the compression ratio in an acceptable range as the displacement is varied. In the embodiment previously disclosed in FIG. 14A and the associated written description, a piston control mechanism (PCM) 1535 is utilized having an anchor-point/beam arrangement to maintain an essentially constant compression ratio throughout a wide range of displacement. In the engine design embodiment illustrated in FIG. 14A, the cylinder centerline 116 is placed at an optimized distance from the power shaft centerline 112. In one example of such design, the maximum deviation in compression ratio over the displacement range is no more than 0.6 percent.

As previously described, in the embodiment illustrated in FIG. 14A, the anchor-point 1568 in the end of the beam 1558 is constrained to remain at a fixed axial location but is allowed to move (i.e., radially) on a line normal to the power shaft 108 by a slot in a shoe 1562 attached to the power shaft. A second point 1578 along the centerline 1566 of the beam 1558 is then selectively moved axially along the centerline 112 of the power shaft 108. A third point along the centerline of the beam defines the motion required to achieve the relationship of $d=K \sin \theta$ where d is the distance of the wobble plate center from a theoretical position at a wobble plate inclination angle (θ) of zero, and K is a constant. The location of this point is defined by the desired compression ratio. The motion of this point is then transferred to the wobble plate by two links 1560, and then to the piston(s) 118 by connecting rods 130 attached to the wobble plate 1528. In such embodiments, a slight deviation in the desired compression ratio may be introduced by changes in angle of the connecting rod with respect to power shaft centerline 112 as wobble plate angle θ is varied; however, when the geometry of the design is optimized the effect of this deviation is negligible to engine performance.

Whereas engine designs such as those illustrated in FIG. 14A may provide an optimized geometry, for example, with respect to the radial spacing of the cylinder axes 116 away from the power shaft axis 112 (e.g., when measured relative to a unit parameter such as the distance from center 146 of the wobble plate 1528 to the center of the lower connecting rod bearing 126), the design of an operational engine must also address other considerations, including but not limited to: space for components for valve actuation, fuel injection and ignition; air quality standards; starter power requirements; and smoothness of engine operation. Addressing some of these considerations may require, for example, moving the cylinder axes 116 further away from the power shaft axis 112 (i.e., radially outward from an optimized configuration), which may tend to increase unwanted variation in compression ratio as the displacement varies over the displacement range. Addressing others of these considerations may require the purposeful addition of small predetermined variations in the compression ratio as the displacement is varied over the displacement range. Accordingly, additional aspects are described herein for use in variable displacement engines, namely: 1) Apparatus for minimization of errors in desired compression ratio as displacement varies in variable displacement engines, especially those having a non-optimized mechanical configuration; and 2) Apparatus for the introduction of predetermined variations in the desired compression ratio at predetermined displacements as the displacement varies in variable displacement engines.

Figure 19:
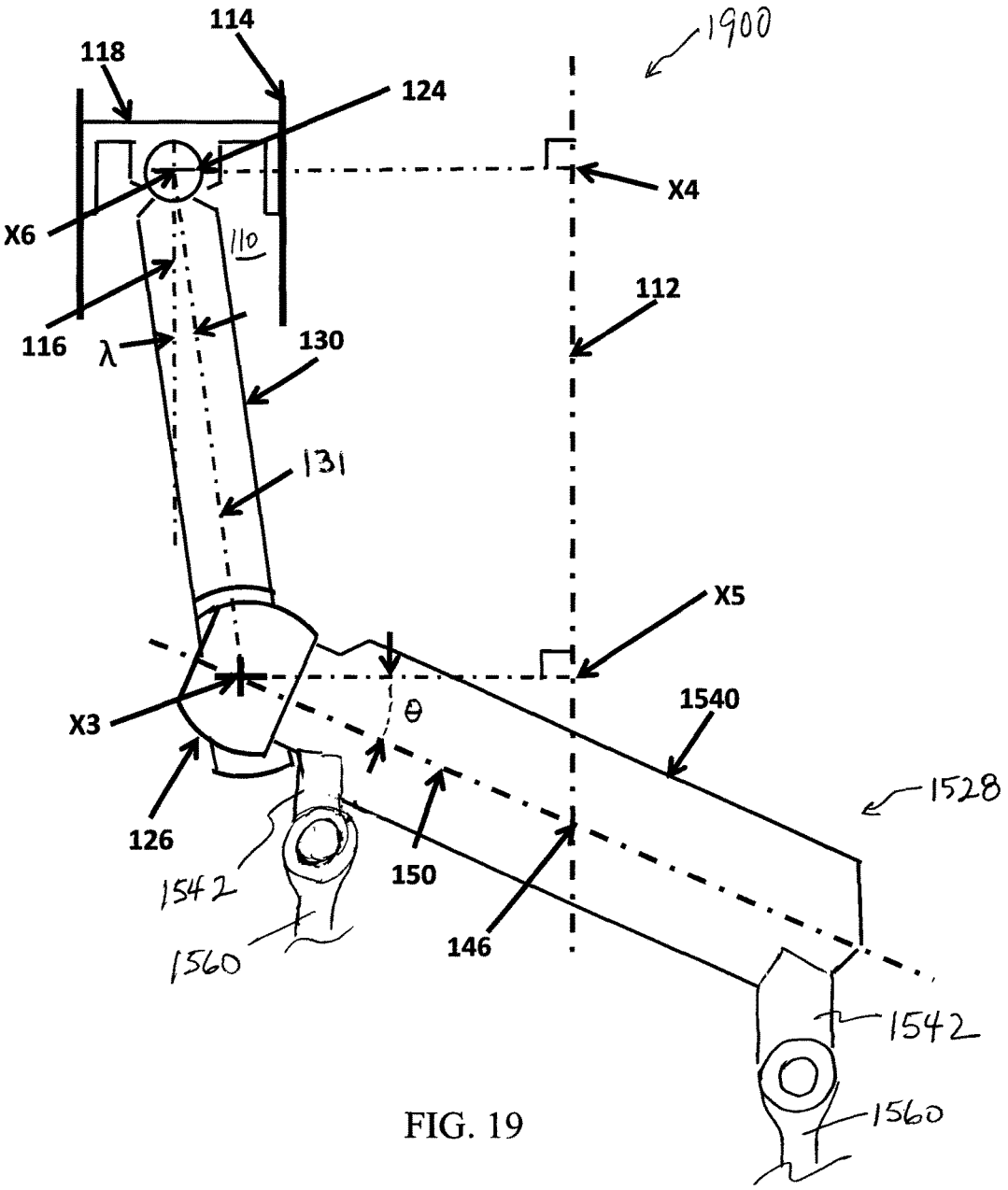
FIG. 19 is a partial schematic side view of another variable-displacement engine similar to the engine of FIG. 14A, but having a different cylinder-to-wobble plate geometric configuration exemplified by the scaled connection of the upper ring portion of the wobble plate to a representative piston (depicted at top-dead-center) and connecting rod positioned within the associated cylinder.

An example of a near-optimized mechanical configuration is illustrated in FIG. 14A, wherein the cylinders 110 are spaced from the power shaft centerline 112 such that the connecting rods 130 are parallel to the power shaft centerline when the wobble plate angle θ is at the midpoint of the displacement range. A non-optimized mechanical configuration, on the other hand, may have connecting rods 130 that are not parallel to the power shaft centerline 112 at the midpoint of the displacement range. For example, the centerlines 116 of the cylinders 110 maybe located radially outside or inside of the optimized configuration. FIG. 19 is one example of a non-optimized configuration where the centerlines 116 of the cylinders 110 are moved outside, i.e., radially outward, from the optimized location. The resulting error in compression ratio as displacement changes is shown in FIG. 20, Case 1.

Figure 18:
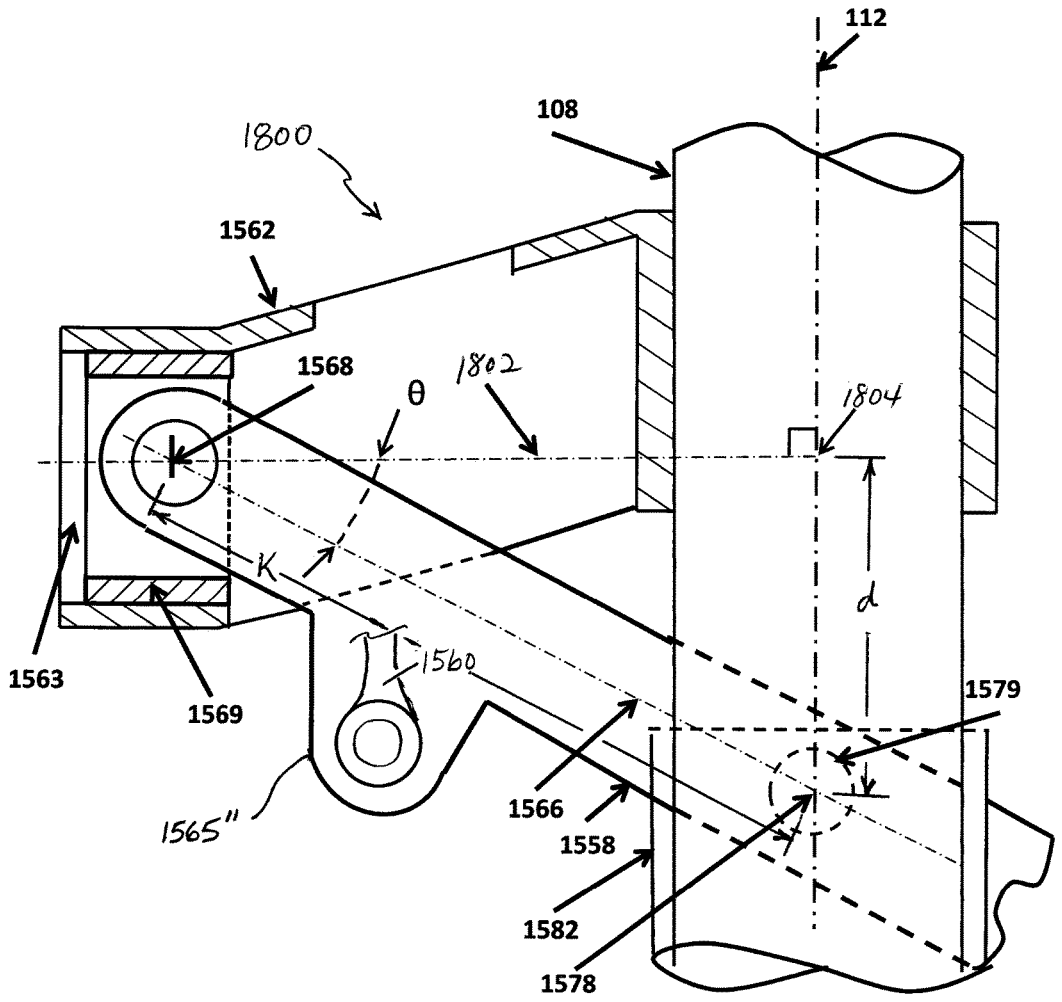
FIG. 18 is an enlarged partial cross-sectional side view of a piston-control mechanism using a shoe and slot mechanism similar to that shown in FIG. 14A, wherein the beam anchor bearing is carried in a slider block moving in a slot defined by the shoe along a path perpendicular to the centerline of the power shaft.
Figure 20:
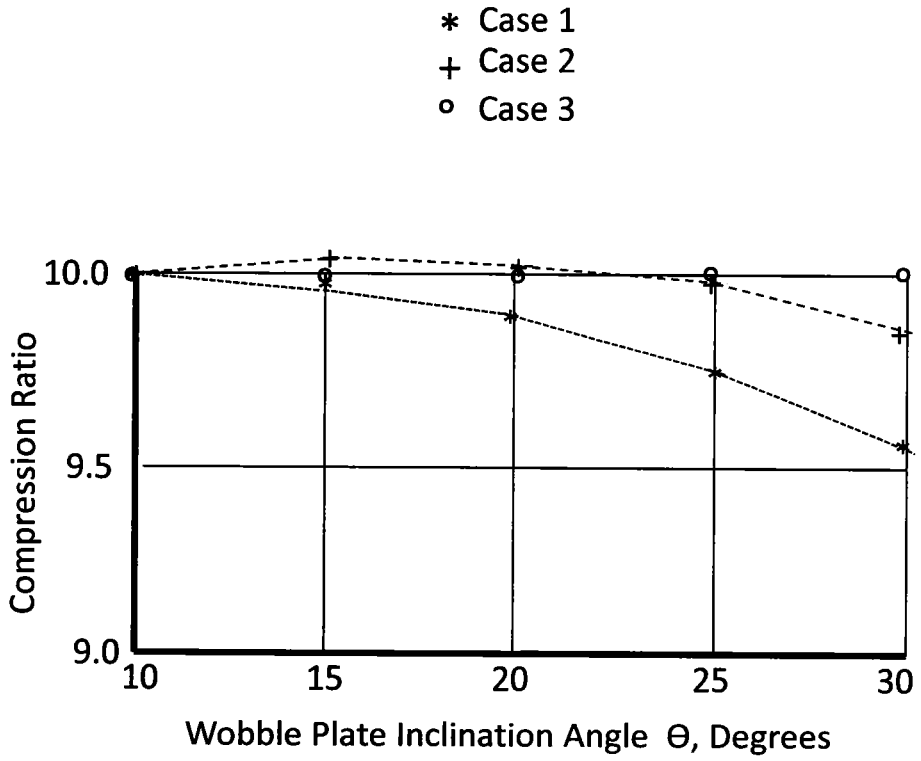
FIG. 20 is a graph showing variations in engine compression ratio as a function of wobble plate angle (and thus also engine displacement) for three different configurations of variable-displacement engine having the cylinder-to-wobble plate geometry shown in FIG. 19, namely, Case 1 being an engine having the perpendicular straight-line piston-control mechanism of FIG. 18, Case 2 being an engine having an inclined straight-line piston-control mechanism as illustrated in FIG. 21 and Case 3 being an engine having the curved-line piston-control mechanism as illustrated in FIG. 22.

Referring now specifically to FIGS. 18, 19 and 20, one example of using changes in the configuration of the slot 1563 of the shoe 1562 to reduce the deviations of compression ratio is illustrated by examining the effect of moving the centerline 116 of the cylinders 110 outward to create more volume for components located in the head region of the engine. FIG. 18 is an illustration of a PCM 1800 for a variable displacement engine, which is similar to the PCM 1535 in FIG. 14A, including a rotating shoe 1562 and lever beam 1558. FIG. 19 illustrates the geometry of a variable displacement engine 1900 similar to engine 1500 of FIG. 14A, except the cylinders 110 are moved outward such that the cylinder bores 116 are moved to the same distance from the power shaft centerline 112 as the distance of the lower connecting rod bearing (point X3) is from the center 146 of the wobble plate 1528. For purposes of illustration in FIG. 19, the piston 118 is shown at top-dead-center with the wobble plate inclination angle (θ) at 30 degrees. When using the PCM 1800 of FIG. 18 on the engine 1900 having the non-optimized geometry of FIG. 19, the effect on the compression ratio of varying the wobble plate inclination angle θ from 9.6 degrees to 30 degrees is shown as Case 1 in FIG. 20. The illustrated variation in angle θ within the range from 9.6 degrees to 30 degrees in FIG. 20 corresponds with a variation in displacement across a range from approximately ⅓ of the maximum displacement value to the maximum displacement value to for the geometry illustrated in FIG. 19. Assuming the desired constant compression ratio has a value=10, Case 1 of FIG. 20 shows the magnitude of the compression ratio error increases continuously as the displacement increases (the compression ratio error being the difference between the desired value of compression ratio and the actual value of compression ratio at a given angle θ or displacement).

Referring in particular to FIG. 18, there are illustrated selected parts of a piston control mechanism ("PCM") 1800 similar to the PCM 1535 previously described in connection with FIG. 14A. The PCM 1800 of FIG. 18 has no correction for errors in compression ratio (i.e., deviations from the desired compression ratio value caused by non-optimized geometry) as displacement is varied. The PCM 1800 incorporates a shoe 1562 defining a slot (i.e., passage way) 1563 for slidably receiving a slider block 1569. One end of a lever beam 1558 encompasses an anchor point 1568 that is attached to the slider block 1569. The slider block 1569 in this embodiment is constrained to movement along a line 1802 normal to the centerline 112 of the power shaft 108. Another point 1578 (i.e., the lift pivot) on the center line 1566 of the lever beam 1558 is constrained to move axially along the center line 112 of the power shaft 108. A lift bearing 1579 at the lift pivot 1578 connects the lever beam 1558 to a lift mechanism 1582. Axial movement of the lift mechanism 1582 along the power shaft 108 changes the inclination angle θ between the lever beam center line 1566 and the line 1802 normal to the power shaft centerline 112. This PCM design results in the relationship d=K sin θ where d is the distance between the line 1804 and pivot point 1578, K is the distance between anchor point 1568 and pivot point 1578, and θ is the inclination angle. This angle θ relationship is transferred to the wobble plate 1528 (see FIG. 19) from the lever beam 1558 by two links 1560 (only partially shown in FIG. 18). This relationship is required in order to maintain a constant compression ratio.

Referring now also to FIGS. 19 and 20, there is illustrated the mechanical configuration of a variable displacement engine having a non-optimized configuration (i.e., for constant compression ratio), but nevertheless a configuration that may be practical for other considerations. In particular, illustrated are the non-rotating part 1540 and rotating part 1542 of the wobble plate 1528, the connecting rod 130, the cylinder 114, and the piston 118. In the illustrated embodiment, the cylinder center line 116 is positioned radially away from the power shaft centerline 112 at a distance equal to the distance between the center 146 of the wobble plate 1528 and the center X3 of the lower connecting rod bearing 126. The piston 118 is shown at top-dead-center and the wobble plate 1528 is shown at the inclination angle θ. This position determines the compression ratio of the engine. The point 146 follows the relationship d=K sin θ as established by the lever beam 1558 as shown in FIG. 18 for a constant compression ratio. However, for the engine to maintain a truly constant compression ratio, the distance between the point X4 (i.e., the point along power shaft axis 112 where a normal line passes through point X6, the upper connection rod bearing center) and the point X5 (i.e., the point along power shaft axis 112 where a normal line passes through point X3, the lower connecting rod bearing center) must also remain constant. For the configuration shown in FIG. 19, the distance between points X4 and X5 is equal to the distance between point X3 and X6 times the cosine of angle), where is the angle between the cylinder bore 116 and the centerline 131 of the connecting rod 130. Since λ is not constant as θ varies, the compression ratio will also vary with θ. The compression ratio error, i.e., how the compression ratio deviates from a constant value for different values of wobble plate angle θ (corresponding to different values of engine displacement), is shown in the graph of FIG. 20, and in particular the line "Case 1" shows the error where there is no compensation for the variation in the distance between X4 and X5.

In particular, FIG. 20 is a graph showing the calculated variation in compression ratio as wobble plate angle θ (and corresponding displacement) is varied over the range of 9.6 degrees to 30 degrees for one example of an engine geometry where the distance from the cylinder centerline 116 to the power shaft axis 112 is equal to the distance of the wobble plate center 146 to the center (X3) of the lower connecting rod bearing 126. Data are presented for three cases of engines having different piston control mechanisms, namely, Case 1 having a PCM 1800 without modifications to the slot in the shoe (i.e., the "straight-line perpendicular path" case); Case 2 having a PCM 2100 wherein the slot is tilted to reduce the deviations in compression ratio as the wobble plate angle θ is changed (i.e., the "straight-line non-perpendicular path" case); and Case 3 having a PCM 2200 wherein the slot is upwardly curved to further reduce deviations in compression ratio as the wobble plate angle θ is changed (i.e., the "curved-line path" case).

Figure 21:
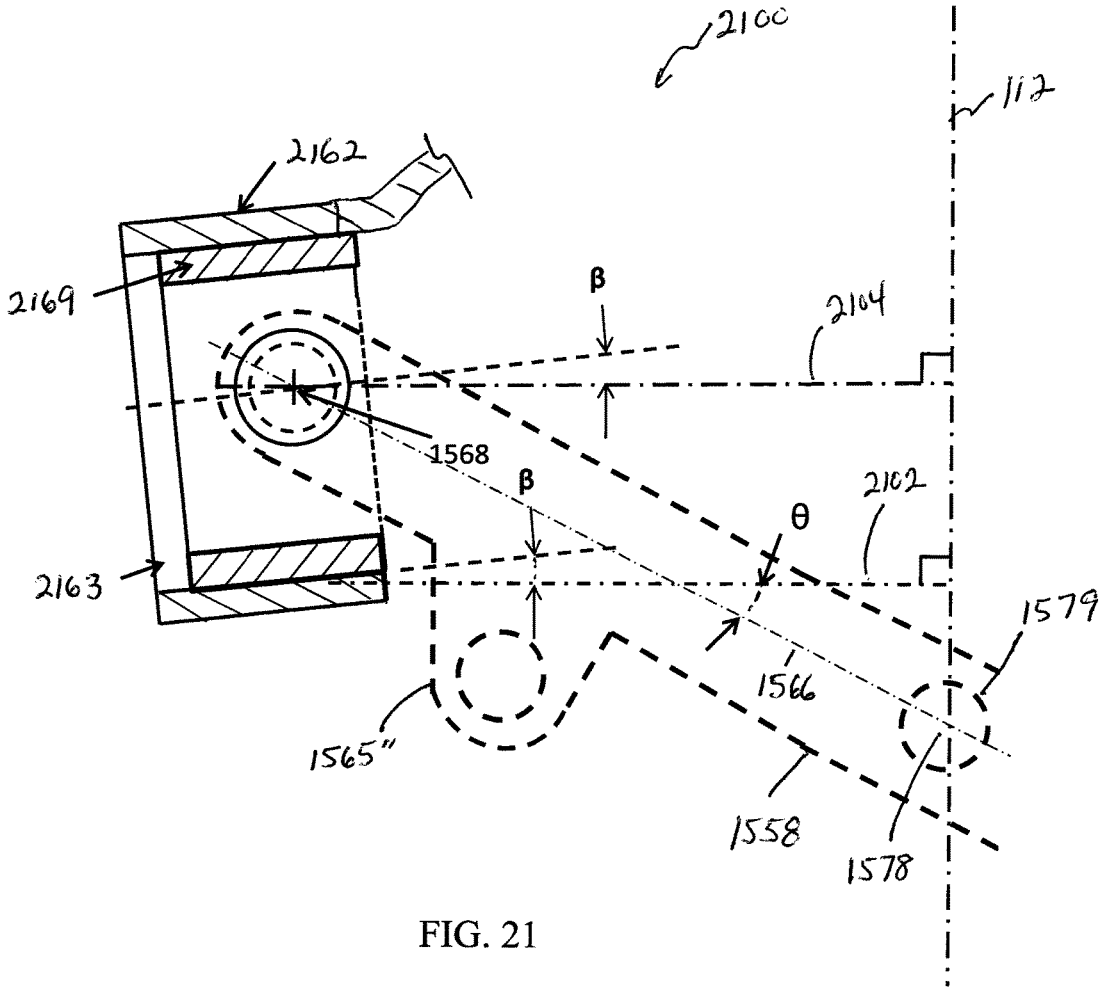
FIG. 21 is an enlarged partial cross-sectional side view of another piston-control mechanism using a shoe and slot mechanism wherein the anchor bearing travels along a straight-line path that is non-perpendicular to the centerline of the power shaft.

Referring now to FIG. 21, there is illustrated another embodiment of a PCM, which is configured to reduce the compression ratio error caused by non-optimized configurations. The PCM 2100 is this embodiment is similar to PCM 1800 except for the configuration of the slot 1563 in the shoe 1562. Without compensation (as seen in Case 1 of FIG. 20) the compression ratio becomes lower as the wobble plate inclination angle θ increases. In order to reduce the deviation from a constant compression ratio as the wobble plate inclination angle θ increases, the piston control mechanism may be modified to compensate for the reduction in the distance from X4 to X5 (see FIG. 19). In particular, the error in compression ratio can be significantly reduced by angling or tilting the slot 1563 in the shoe 1562 (i.e., relative to a normal line extending from the power shaft axis 112). One example of such modification is illustrated in FIG. 21. The part of the shoe 2162 forming the slot 2163 is tilted upward by an angle β. As the wobble plate inclination angle θ increases, the slider block 2169 moves along the slant of the slot 2163 and causes the anchor point 1568 to also move along at the same angle β, resulting in the anchor point moving axially upward (i.e., away from the pivot point 1578) a short distance. This upward movement of the anchor point 1568 offsets some of the decrease in distance between points X4 and X5 (FIG. 19). The compression ratio as a function of wobble plate angle θ for this configuration of the slot is shown as Case 2 in the graph of FIG. 20.

The alternative PCM 2100 may be used in the variable-displacement engine 1900 (i.e., instead of the PCM 1800) to reduce the compression ratio error. As described, the PCM 2100 may be similar to the PCMs 1535 and 1800 except the slot 2163 of the shoe 2162 is inclined an angle β with respect to a normal (i.e., perpendicular) line 2102 extending from the power shaft centerline 112 as shown in FIG. 21. The inclined slot 2163 forces the slider 2169 and anchor point 1568 to also move radially at the angle β with respect to another normal line 2104 extending from the centerline 112. The corresponding effect on compression ratio error versus wobble plate angle θ (and thus displacement) of using PCM 2100 in the engine 1900 is shown as Case 2 in FIG. 20. Again assuming the desired constant compression ratio has a value=10, it will be appreciated that Case 2 of FIG. 20 shows the magnitude of the compression ratio error using the PCM 2100 having an inclined slot 2163 is significantly reduced as displacement increases compared with Case 1 using the PCM 1800 with a perpendicular slot 1563.

Figure 22:
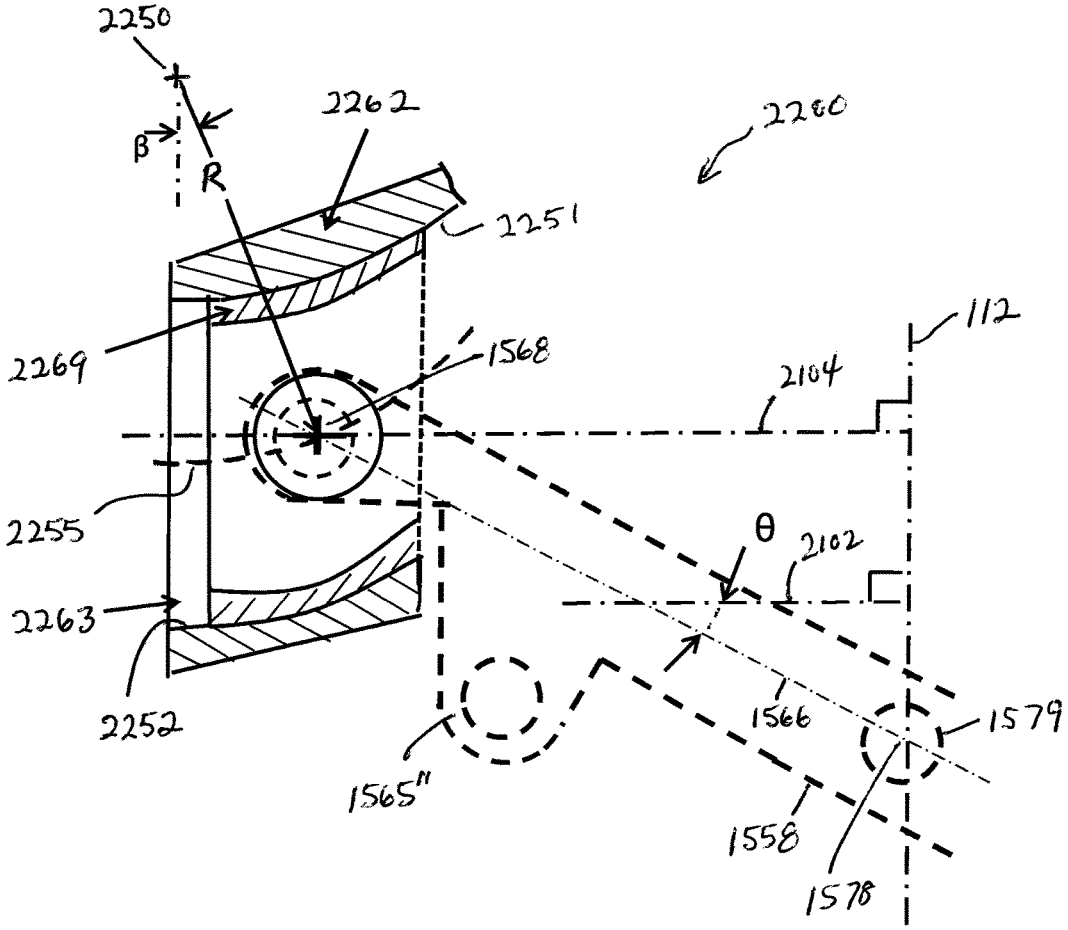
FIG. 22 is an enlarged partial cross-sectional side view of another piston-control mechanism using a shoe and slot mechanism wherein the anchor bearing travels along a curved-line path having a center of curvature disposed axially between the piston and the anchor bearing.

Referring now to FIG. 22, there is illustrated another alternative PCM 2200 that is configured to reduce compression ratio errors. The PCM 2200 is generally similar to the PCMs previously described except for the configuration of the slot in the shoe and the slider block. In particular, the slot 2263 in the shoe 2262 is modified to include a combination of tilt angle β (which may not be of the same magnitude as in PCM 2100) and curvature of radius R. By selecting the appropriate values of β and R, the curved slot 2263 and its matching slider block 2269 may significantly reduce the deviation in compression ratio from the desired value (i.e., the compression ratio error) as the wobble plate inclination angle θ is varied. The resulting compression ratio versus wobble angle θ graph is shown as Case 3 in FIG. 20.

The alternative PCM 2200 may be used in the engine 1900 (i.e., instead of the PCM 1800 or 2100) to reduce the compression ratio error as the displacement varies. The PCM 2200 in the illustrated embodiment is similar to the PCMs 1535, 1800 and 2100 except the slot 2263 of the shoe 2262 is upwardly curved about a control point 2250 disposed radially away from the power shaft axis 112 and axially between the pistons 118 and the anchor bearing 1568. As further described herein, in other embodiments, the slot 2263 may be downwardly curving. It will be appreciated that the radii of the top wall 2251 and the bottom wall 2252 of the slot 2263 will be different from one another since they lie at different distances from the control point 2250, however, the respective radii are selected to allow a correspondingly curved slider 2269 to move through the shoe 2262 such that the anchor point 1568 travels along a curved-line path 2255 having a radius R about the control point 2250. In the illustrated embodiment, the anchor bearing 1568 of the slider block 2269 follows a circular-path 2255 around the control point 2250; however in other embodiments, other curved paths may be used. The position of control point 2250 may be further specified by a tilt angle β, which may or may not be of the same magnitude as angle β in PCM 2100). The corresponding effect on compression ratio error versus wobble plate angle θ (and thus displacement) of using PCM 2200 in the engine 1900 is shown as Case 3 in FIG. 20. Again assuming the desired constant compression ratio has a value=10, it will be appreciated that Case 3 of FIG. 20 shows the magnitude of the compression ratio error using the PCM 2200 having a curved slot 2263 is significantly reduced as displacement increases compared with Cases 1 and 2 using the PCMs 1800 and 2100, respectively.

Figure 23:
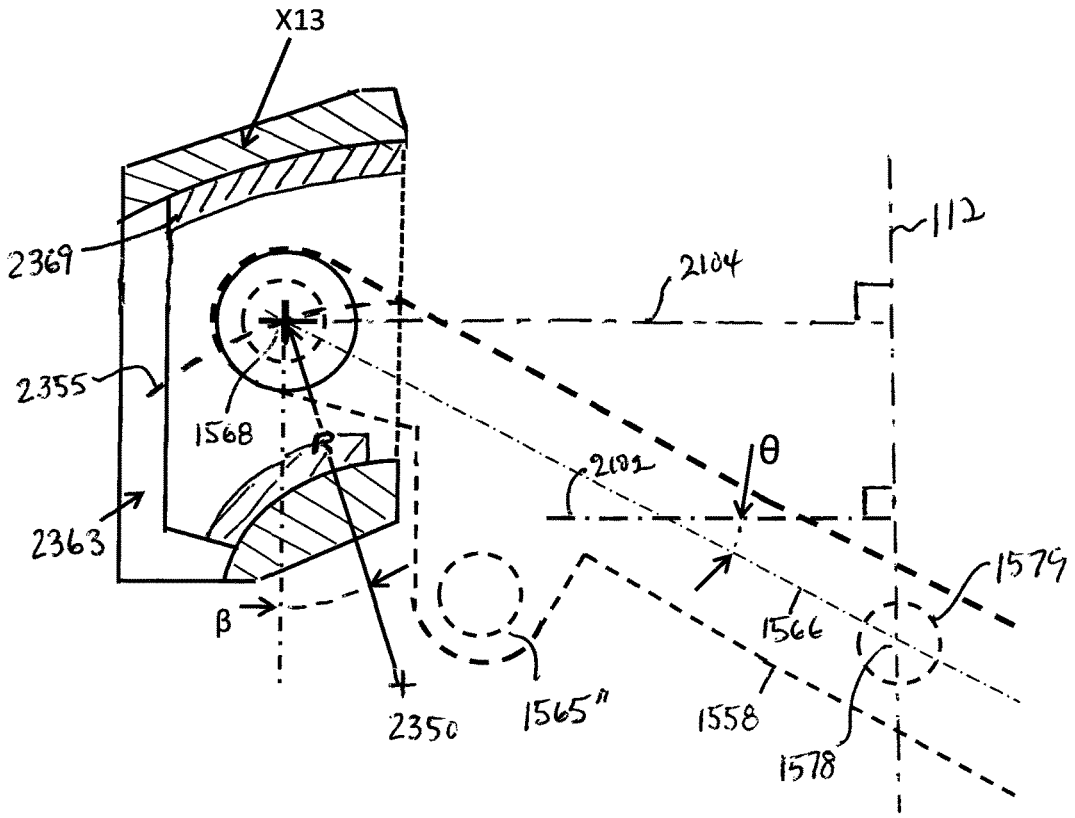
FIG. 23 is an enlarged partial cross-sectional side view of another piston-control mechanism using a shoe and slot mechanism wherein the anchor bearing travels along a curved-line path and wherein the anchor bearing is disposed axially between the piston and the center of curvature of the curved-line path.
Figure 24:
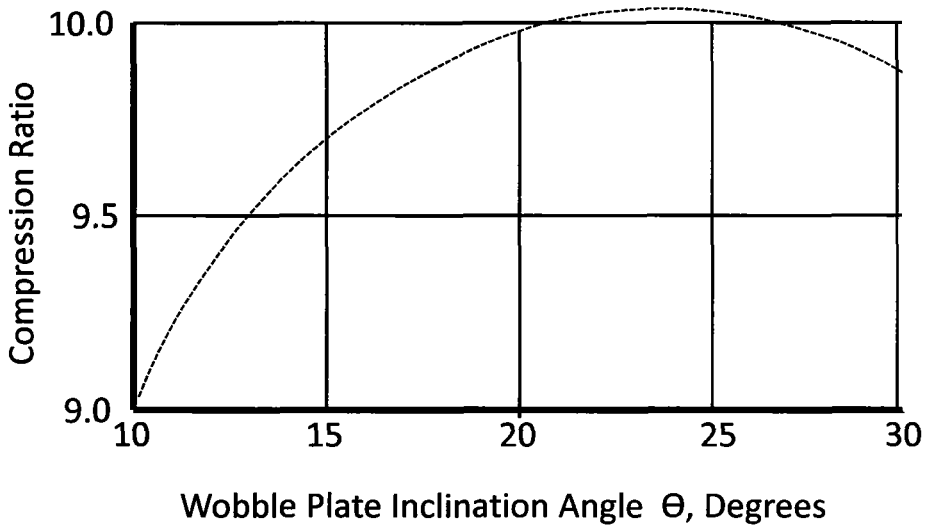
FIG. 24 is a graph showing variations in engine compression ratio as a function of wobble plate angle (and thus also engine displacement) for a variable-displacement engine having the cylinder-to-wobble plate geometry shown in FIG. 19 and having the curved-path piston control mechanism of FIG. 23.

Referring now to FIGS. 23 and 24, other aspects of the design of the slot in the shoe can be used to address other considerations such as lowering the compression ratio near minimum displacement if problems are encountered with smoothness in operation at idle (i.e., at minimum displacement). A PCM for lowering the compression ratio at minimum displacement may use a downwardly curved slot in the shoe and have a control point disposed such that the anchor bearing is disposed axially between the piston and the control point. One example of such a PCM using a downwardly curved slot to provide this feature is PCM 2300 shown in FIG. 23. The resulting compression ratio as a function of wobble plate angle θ (i.e., displacement) for the PCM 2300 embodiment of FIG. 23 is shown in the graph of FIG. 24.

Referring now particularly to FIG. 23, the PCM 2300 may be used in the variable-displacement engine 1900 (i.e., instead of the PCM 1800, 2100 or 2200) to provide a predetermined variable compression ratio as the displacement varies. As previously discussed, engines with high compression ratios often experience rough engine operation at idle. In some variable-displacement engine designs, the displacement is automatically reduced to minimum displacement at engine idle operation. In such engines, the rough operation problem can be addressed by reducing the compression ratio at minimum displacement, for example by means of a modification to the configuration of a curved slot 2363 and a corresponding curved slider block 2369 (FIG. 23).

In further detail, the PCM 2300 may have a downwardly curved slot 2363 in the shoe 2362 defined by a control point 2350 disposed radially away from the power shaft axis 112 and disposed axially such that the anchor bearing 1568 is axially between the piston 118 and the control point. The curved slot 2363 may slidingly receive a corresponding curved slider block 2369. In the illustrated embodiment, the anchor bearing 1568 of the slider block 2369 follows a circular-path 2355 around the control point 2350; however in other embodiments, other curved paths may be used. This configuration may be further defined by a tilt angle β and a radius of curvature R that are different than in previous embodiments. The objective in this design is to reduce the compression ratio at minimum displacement from the nominal design compression ratio of 10 while keeping the compression ratio near 10 over the normal operating range of the engine.

Referring now also to FIG. 24, there is illustrated the calculated compression ratio as a function of wobble plate inclination angle θ resulting from use of PCM 2300. The compression ratio at wobble plate angle θ=10 degrees (corresponding to minimum displacement) has a value of 9.0, but rapidly increases as angle θ increases (corresponding to increasing displacement) to produce a compression ratio value of approximately 10 for the upper portion of the displacement range (e.g., for the upper 50% of the displacement range).

For embodiments using a curved slot and corresponding curved-path or circular-path anchor bearing movement, the parameters of the curved slot, namely radius R and angle β, maybe determined mathematically or by other techniques including curve fitting. In one example, a first position of the anchor bearing center necessary to get the desired compression ratio at minimum displacement is determined and a second position of the anchor bearing center necessary to get the desired compression ratio at maximum displacement is determined. Next, knowing that the travel path of the anchor bearing center must be circular, an intermediate point at the mid range of the displacement can be determined to give the desired compression ratio. A circular curve is then fitted through the three points to provide the necessary or desired travel path for the of the anchor bearing center. The sinusoidal error produced by the curved slot mechanism can also be scaled to offset the sinusoidal error produced by the angle of the connecting rod, such that the overall error in compression ratio is largely eliminated.

It will be appreciated by those skilled in the art having the benefit of this disclosure that this engine provides a continuously variable displacement while maintaining essentially a constant compression ratio over the range of displacements. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A variable-displacement engine comprising:

an engine block;

an elongated power shaft rotatably supported by the engine block, the power shaft having a longitudinal power shaft axis defining an axial direction and being fixed axially relative to the engine block;

a cylinder block fixedly mounted to the engine block, the cylinder block defining at least one cylinder, each cylinder having a bore defining a bore axis aligned substantially parallel to the power shaft axis;

one or more pistons corresponding in number to the number of the cylinders, each respective piston being slidably disposed within the bore of a respective cylinder;

one or more connecting rods corresponding in number to the number of cylinders, each respective connecting rod having an upper end connected to a respective piston and a lower end connected to a respective connecting rod bearing;

a wobble plate assembly having a generally annular configuration defining a central opening through which the power shaft passes, the wobble plate assembly including a non-rotating first ring portion, the first ring portion including one or more bearing mounting arms formed thereon, corresponding in number to the number of the connecting rods, each bearing mounting arm having the respective connecting rod bearing mounted thereon, and a rotating second ring portion, the second ring portion being rotatably slidably connected to the first ring portion so as to allow the second ring portion to rotate relative to the first ring portion about a common ring center line while constraining the second ring portion to remain parallel to the first ring portion, and a rotation-locking assembly connected between the first ring portion and the engine block to rotationally lock the first ring portion to the engine block while allowing the first ring portion to vary an angle of inclination with respect to the power shaft axis, the wobble plate assembly defining a wobble plate inclination plane being a plane passing through the centers of the connecting rod bearings, a wobble plate pivot axis being a line lying in the wobble plate inclination plane and intersecting the power shaft axis in a perpendicular orientation and rotating with the power shaft, and a wobble plate angle $\theta$ being an angle of intersection between the wobble plate inclination plane and a plane normal to the power shaft axis when viewed in a direction parallel to the pivot axis;

a piston control mechanism including an anchor support member attached to the power shaft to rotate with the power shaft and extending radially outward from the power shaft to an outer end, the outer end of the anchor support member forming a radially-oriented passageway wherein at least a portion of the passageway is non-perpendicular with respect to the power shaft axis;

a slider block slidingly mounted in the passageway and constrained to move along a path defined by the passageway;

a lift mechanism slidably mounted on the power shaft for axial movement along the power shaft axis, a lever beam supported at a first location by pivot bearings mounted to the lift mechanism along a normal line passing through the power shaft axis parallel to the wobble plate pivot axis and supported at a second location by an anchor bearing carried by the anchor support member, thereby defining a lever beam centerline passing through the centers of the pivot bearing and the anchor bearing and an lever beam angle being an angle between the lever beam centerline and the plane normal to the power shaft axis when viewed in a direction parallel to the pivot axis;

one or more connecting links, each connecting link having a first end connected to the second ring portion of the wobble plate and a second end connected to the lever beam;

wherein the anchor bearing is mounted in the slider block to be movable in a radial direction along the path defined by the passageway extending from the power shaft axis, the path having components in both the radial and axial directions and constrained to move in a circumferential direction around the power shaft axis with the anchor support member; and whereby operation of the lift mechanism to selectively change the axial position of the lever beam pivot bearings selectively changes the lever beam angle, which in turn selectively changes, via the connecting links, the wobble plate angle $\theta$ and an axial distance d between the wobble plate pivot axis and a theoretical zero angle point, which in turn selectively changes the piston displacement of the engine while maintaining the compression ratio of the engine at a substantially constant value.

2. A variable-displacement engine in accordance with claim 1, wherein the radially-oriented passageway of the anchor support member is oriented at a non-perpendicular angle $\beta$ with respect to the power shaft axis such that movement of the anchor bearing along the path as the axial position of the lever beam pivot bearing changes is along a straight line intersecting the power shaft axis at the non-perpendicular angle $\beta$.

3. A variable-displacement engine in accordance with claim 1, wherein the radially-oriented passageway of the anchor support member is curved such that movement of the anchor bearing along the path as the axial position of the lever beam pivot bearing changes is along a curved line.

4. A variable-displacement engine in accordance with claim 3, wherein the radially-oriented passageway of the anchor support member is curved such that movement of the anchor bearing along the path as the axial position of the lever beam pivot bearing changes is along a circular path having a radius R about a control point disposed adjacent to the power shaft axis.

* * * * *